US011841635B2

(12) United States Patent
Saito

(10) Patent No.: US 11,841,635 B2
(45) Date of Patent: Dec. 12, 2023

(54) DEVELOPING DEVICE

(71) Applicant: CANON KABUSHIKI KAISHA, Tokyo (JP)

(72) Inventor: Fumiyoshi Saito, Ibaraki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 18/093,376

(22) Filed: Jan. 5, 2023

(65) Prior Publication Data

US 2023/0236525 A1 Jul. 27, 2023

(30) Foreign Application Priority Data

Jan. 27, 2022 (JP) ..... 2022-011048

(51) Int. Cl.
*G03G 15/08* (2006.01)
*G03G 21/00* (2006.01)

(52) U.S. Cl.
CPC ..... *G03G 15/0808* (2013.01); *G03G 15/0868* (2013.01); *G03G 15/0889* (2013.01); *G03G 21/0047* (2013.01)

(58) Field of Classification Search
CPC ..... G03G 15/0808; G03G 15/0812; G03G 15/0868; G03G 15/0887; G03G 15/0891; G03G 21/0047
See application file for complete search history.

(56) References Cited

U.S. PATENT DOCUMENTS

| | | | | |
|---|---|---|---|---|
| 9,599,926 | B2 | 3/2017 | Ishida et al. | |
| 9,658,573 | B2 | 5/2017 | Saito | |
| 2012/0201575 | A1 | 8/2012 | Kashimoto et al. | |
| 2013/0209142 | A1* | 8/2013 | Kusukawa | G03G 15/0812 399/274 |
| 2017/0075254 | A1* | 3/2017 | Tauchi | G03G 15/0812 |
| 2020/0142334 | A1* | 5/2020 | Watanabe | G03G 21/105 |

FOREIGN PATENT DOCUMENTS

| | | |
|---|---|---|
| JP | 2018-132628 A | 8/2018 |
| JP | 2019-078828 A | 5/2019 |
| JP | 2019-128442 A | 8/2019 |

* cited by examiner

*Primary Examiner* — Hoang X Ngo
(74) *Attorney, Agent, or Firm* — VENABLE LLP

(57) ABSTRACT

A developing device includes a developing container, a developing roller, a supplying roller, a first magnet including a first magnetic pole, a second magnet including a second magnetic pole and a third magnetic pole, and a regulating member provided opposed to the third magnetic pole. During non-image formation, an operation in a mode in which the supplying roller is rotated in a direction opposite to a rotational direction of the supplying roller during image formation is executable. With respect to the rotational direction of the supplying roller during the image formation, a position where a magnet flux density of the third magnetic pole in a tangential direction to an outer peripheral surface of the supplying roller is zero is positioned downstream of an upstream end of the regulating member and upstream of the second magnetic pole.

7 Claims, 10 Drawing Sheets

DEVELOPING DEVICE

FIELD OF THE INVENTION AND RELATED ART

The present invention relates to a developing device including a supplying roller and a developing roller.

In the developing device, conventionally, one using a two-component developer containing toner comprising non-magnetic particles and a carrier comprising magnetic particles (hereinafter, the two-component developer is simply referred to as the developer) has been known. As such a developing device, a constitution using a so-called hybrid developing type including a developing roller as a rotatable developing member provided opposed to a photosensitive drum as an image bearing member and a supplying roller as a rotatable supplying member provided opposed to the developing roller has been proposed (United states Patent Application Publication No. US2012/0201575 A1).

In the developing device using such a hybrid type, the developer is carried on the supplying roller in which a magnet is provided and a toner layer is formed on the developing roller from the developer conveyed by rotation of the supplying roller, and then an electrostatic latent image on the photosensitive drum is developed with toner supplied from the developing roller.

In the developing device disclosed in US2012/0201575 A1, the magnet disposed inside the supplying roller includes a magnetic pole in a position opposing the developing roller, and a magnet provided inside the developing roller includes a receiving pole different in polarity from the main pole in a position opposing the supplying roller. Further, on a side upstream of the main pole with respect to a rotational direction of the supplying roller, a regulating member for regulating an amount of the developer carried on the supplying roller is provided. Further, a constitution disposed in US2012/0201575 A1 includes a toner receiving member provided below the developing roller and for receiving the toner dropping from the developing roller and a vibration generating means for vibrating the toner receiving member.

In the case of such a constitution disclosed in US 2012/0201575 A1, during non-image formation, the toner receiving member is vibrated and the supplying roller is rotated in a direction opposite to the rotational direction thereof during image formation. By this, the toner dropped and deposited in a regulating member sandwiched by the toner receiving member and the supplying roller is moved with rotation of the supplying roller at the supplying roller surface, so that the toner is caused to pass through a gap between the supplying roller and the regulating member and thus is collected in a developing container.

In the case of the above-described constitution disclosed in US 2012/0201575 A1, during the non-image formation, the toner receiving member is vibrated and the supplying roller is rotated in the direction opposed to the rotational direction during the image formation, and therefore, when a frequency of this operation becomes high, productivity lowers. Therefore, it is desired that collection efficiency of the toner moved with rotation of the supplying roller at the supplying roller surface and passing through the gap between the supplying roller and the regulating member is improved.

SUMMARY OF THE INVENTION

A principal object of the present invention is to provide a developing device including a supplying roller and a developing roller and capable of improving collection efficiency of toner moved with rotation of the supplying roller at a supplying roller surface and passing through a gap position between the supplying roller and a regulating member.

According to an aspect of the present invention, there is provided a developing device comprising: a developing container configured to accommodate a developer containing toner and a carrier; a developing roller configured to carry and convey the toner to a developing position where an electrostatic latent image formed on an image bearing member is developed with the toner; a supplying roller provided opposed to the developing roller and configured to supply only the toner to the developing roller while carrying and conveying the developer supplied from the developing container, the supplying roller being rotated during image formation in a rotational direction opposite to a rotational direction of the developing roller in a position where the supplying roller and the developing roller oppose each other; a first magnet provided non-rotationally and fixedly inside the developing roller and including a first magnetic pole; a second magnet provided non-rotationally and fixedly inside the supplying roller and including: a second magnetic pole which is provided opposed to the first magnetic pole in a position where the supplying roller opposes the developing roller and which is different in polarity from the first magnetic pole, and a third magnetic pole which is provided on a side upstream of the second magnetic pole with respect to the rotational direction of the supplying roller during the image formation, and a regulating member provided opposed to the third magnetic pole and configured to regulate an amount of the developer carried on the supplying roller, wherein during non-image formation, an operation in a mode in which the supplying roller is rotated in a direction opposite to the rotational direction of the supplying roller during the image formation is executable, and wherein with respect to the rotational direction of the supplying roller during the image formation, a position where a magnet flux density of the third magnetic pole in a tangential direction to an outer peripheral surface of the supplying roller is zero is positioned downstream of an upstream end of the regulating member and upstream of the second magnetic pole.

Further features of the present invention will become apparent from the following description of exemplary embodiments with reference to the attached drawings.

Figure 6:
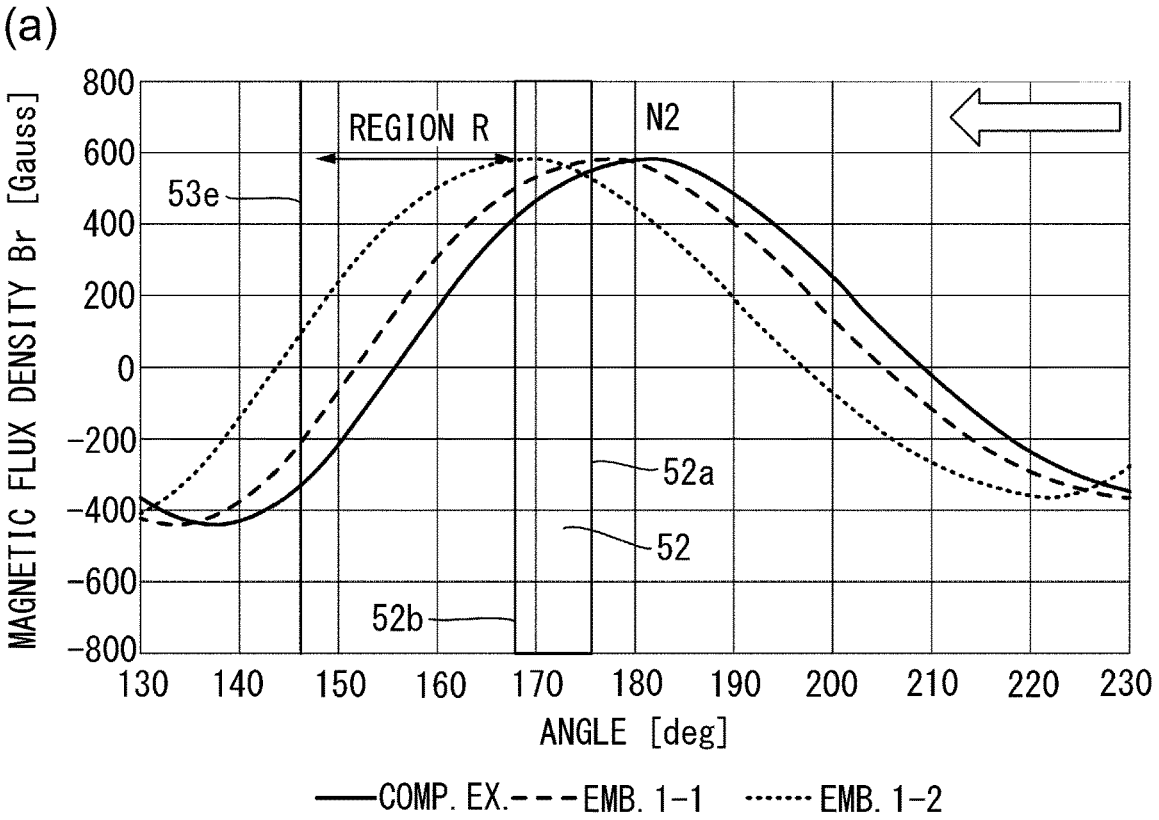
Figure 6:
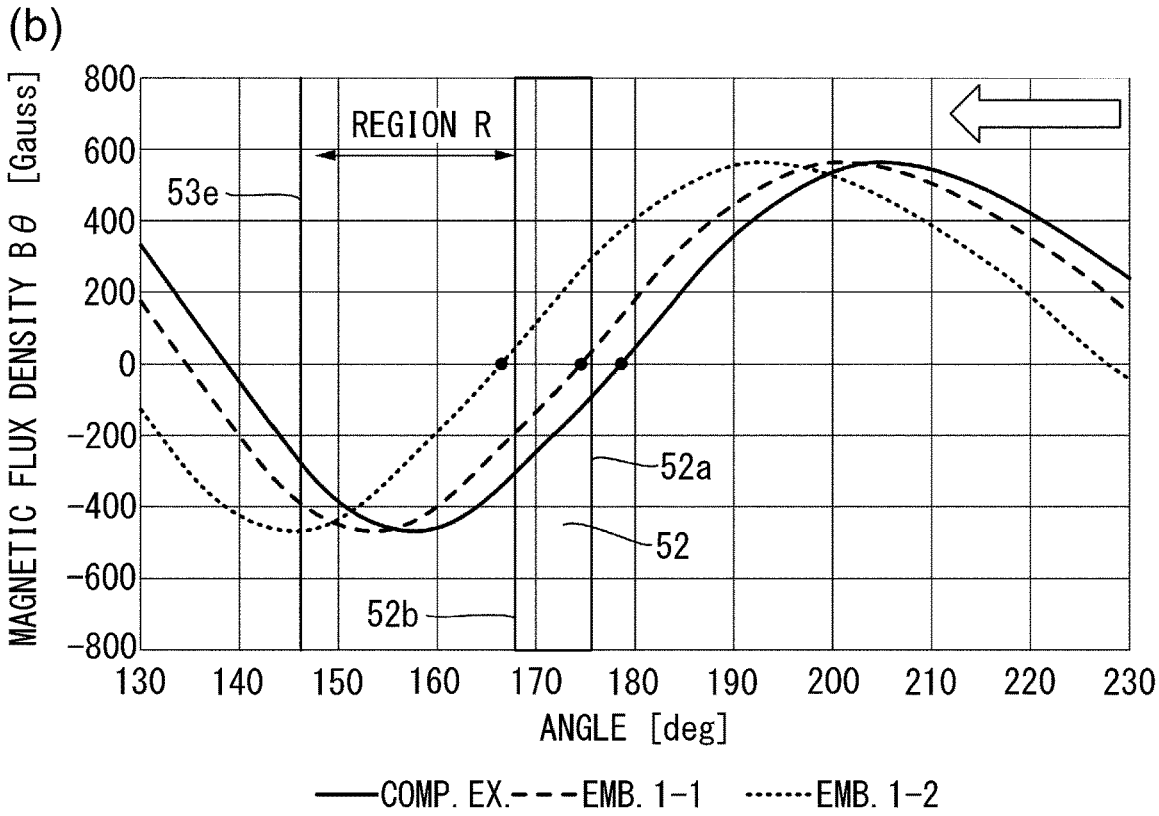

Part (a) of FIG. 6 is a graph showing a relationship between an angle of a supplying roller and a magnetic flux density Br in a normal direction in combination with an arrangement region of a regulating blade in each of an embodiment 1-1, an embodiment 1-2, and a comparison example, and part (b) of FIG. 6 is a graph showing a relationship between the angle of the supplying roller and a magnetic flux density Br in a tangential direction in combination with the arrangement regulating of the region in each of the embodiment 1-1, the embodiment 1-2, and the comparison example.

Figure 7:
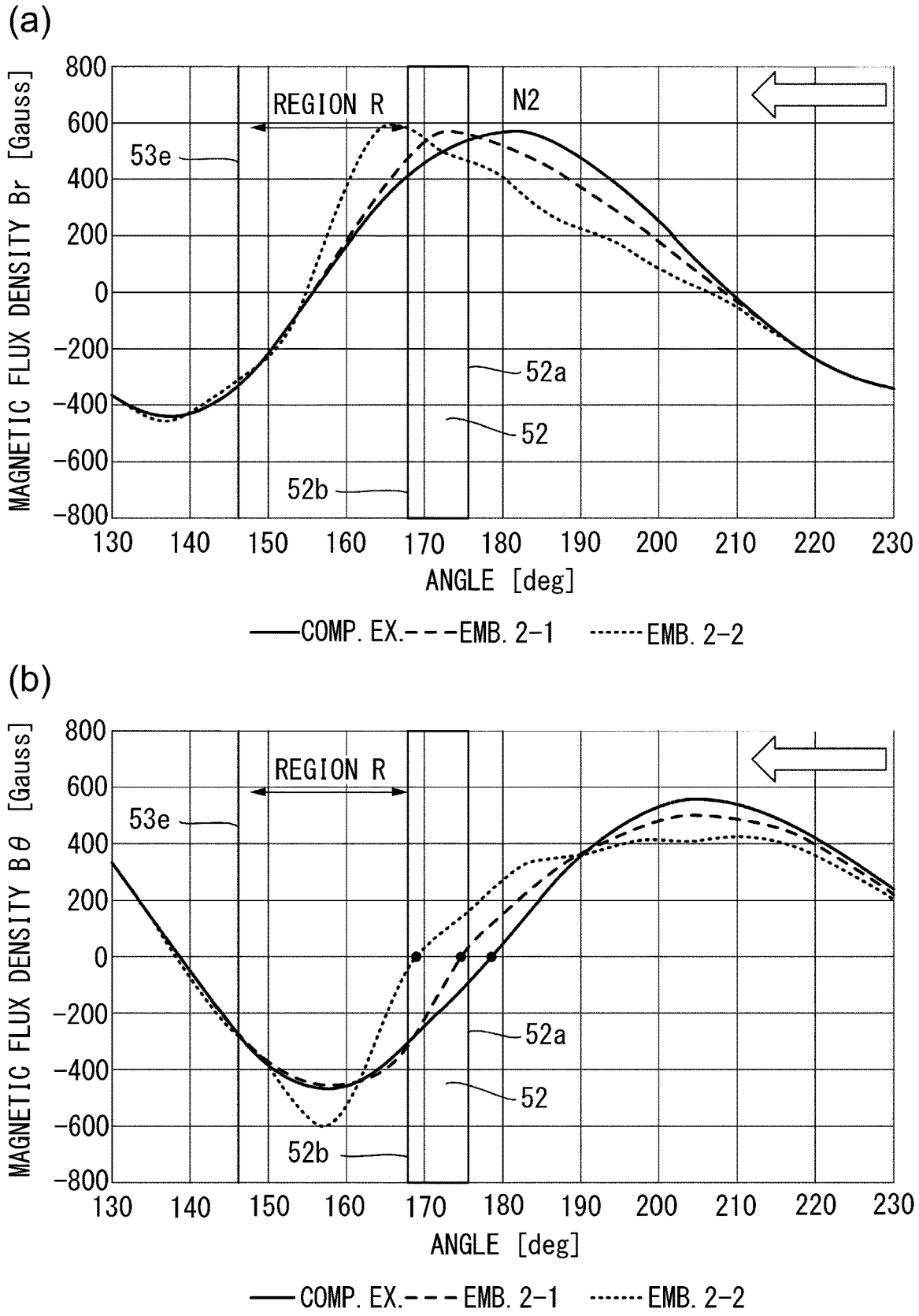

Part (a) of FIG. 7 is a graph showing a relationship between an angle of a supplying roller and a magnetic flux density Br in a normal direction in combination with an arrangement region of a regulating blade in each of an embodiment 2-1, an embodiment 2-2, and a comparison example, and part (b) of FIG. 7 is a graph showing a relationship between the angle of the supplying roller and a magnetic flux density Br in a tangential direction in combination with the arrangement regulating of the region in each of the embodiment 2-1, the embodiment 2-2, and the comparison example.

Figure 8:
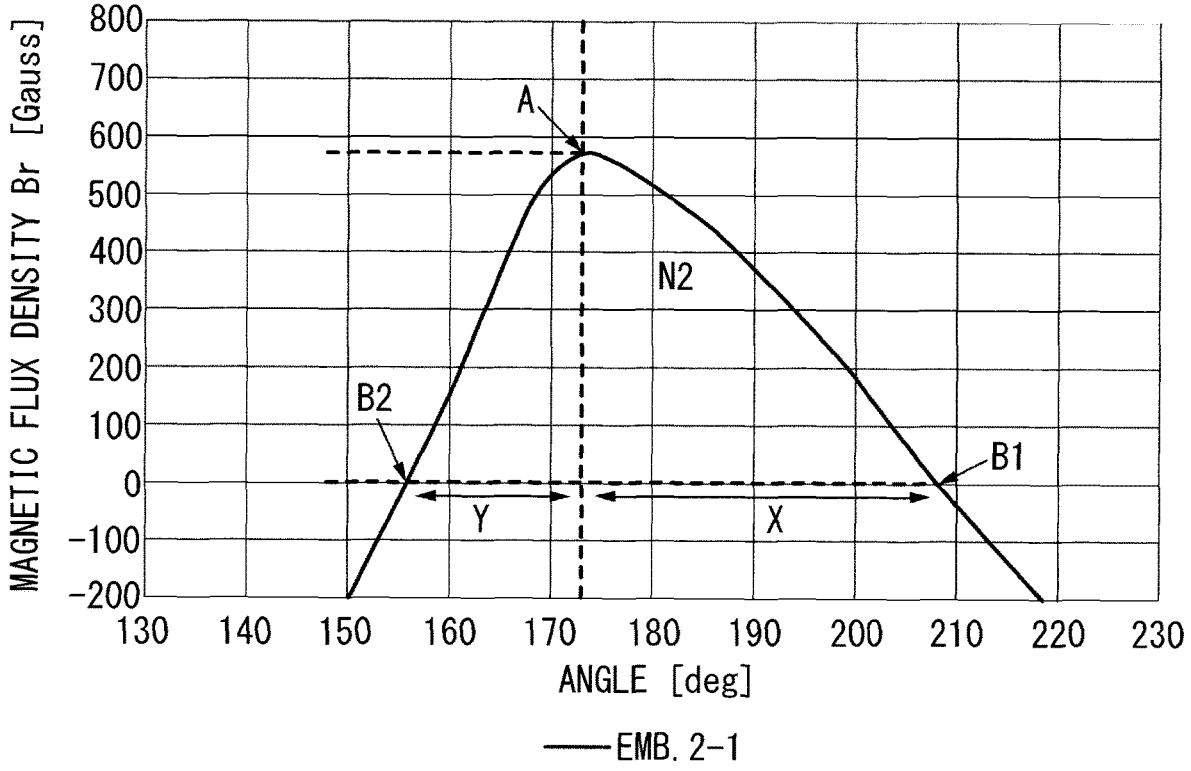

FIG. 8 is a graph showing a relationship between the angle of the supplying roller and the magnetic flux density Br in the normal direction, in which a region of a regulating pole in the embodiment 2-1 is shown in an enlarged manner.

Figure 9:
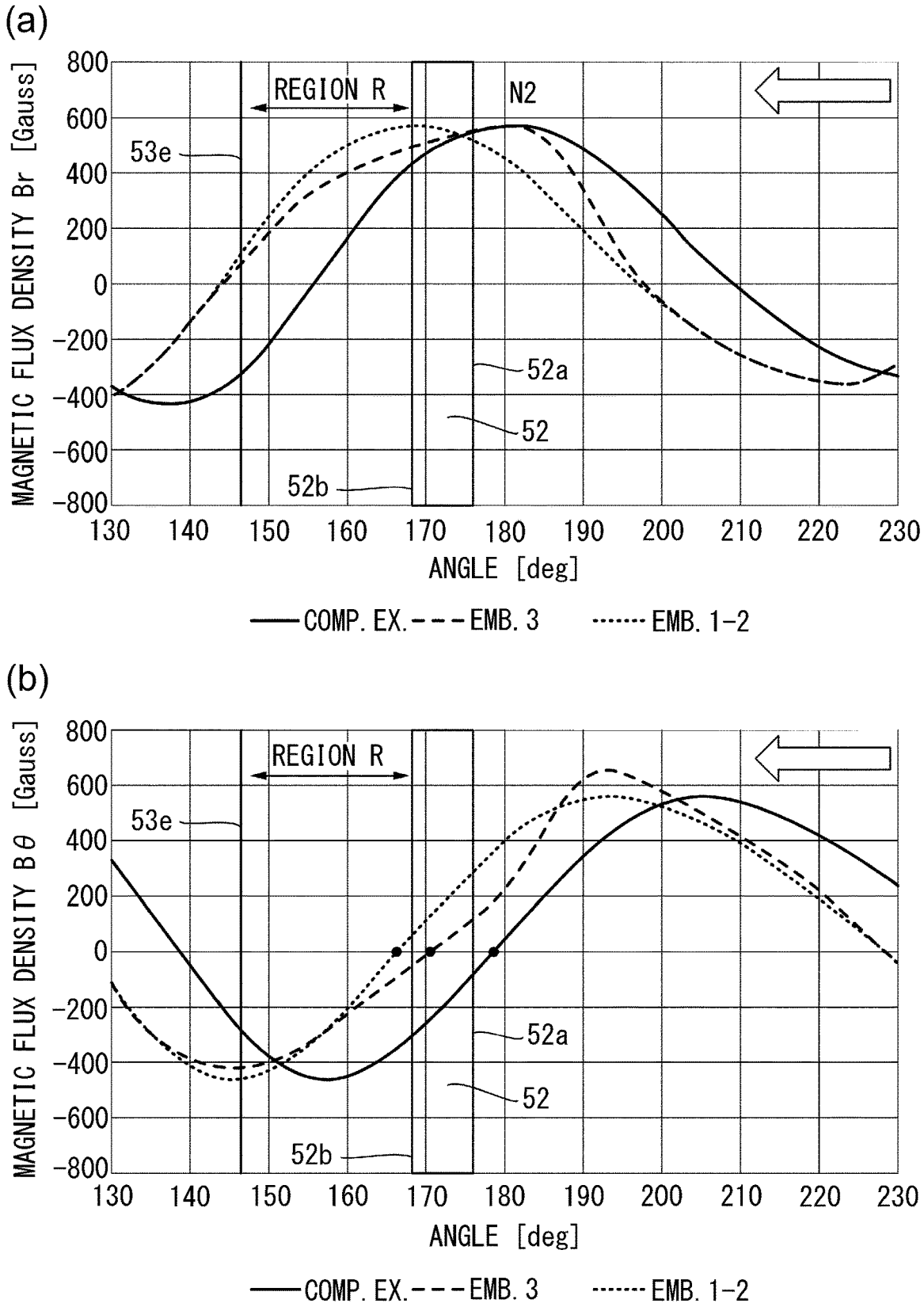

Part (a) of FIG. 9 is a graph showing a relationship between an angle of a supplying roller and a magnetic flux density Br in a normal direction in combination with an arrangement region of a regulating blade in each of an embodiment 3, an embodiment 1-2, and a comparison example, and part (b) of FIG. 9 is a graph showing a relationship between the angle of the supplying roller and a magnetic flux density Br in a tangential direction in combination with the arrangement regulating of the region in each of the embodiment 3, the embodiment 1-2, and the comparison example.

Figure 10:
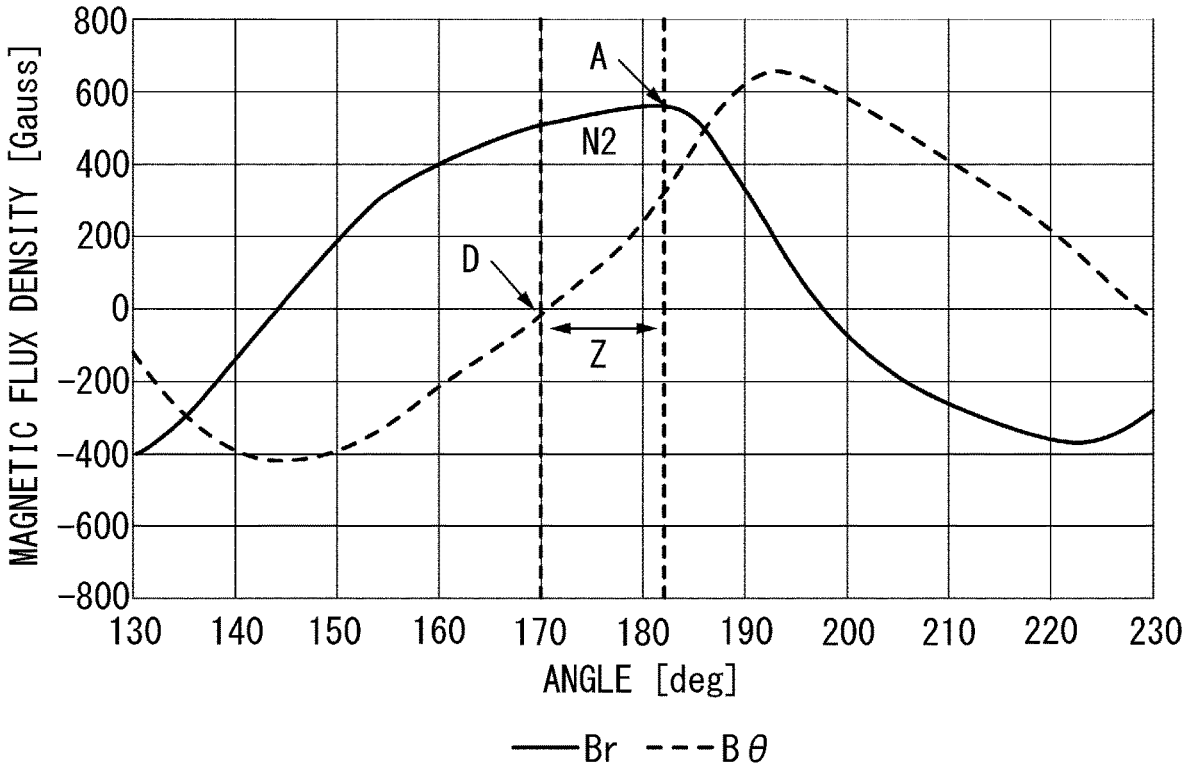

FIG. 10 is a graph showing a relationship between the angle of the supplying roller, the magnetic flux density Br in the normal direction, and the magnetic flux density Br in the tangential direction, in which a region of a regulating pole in the embodiment 3 is shown in an enlarged manner.

DESCRIPTION OF THE EMBODIMENTS

First Embodiment

A first embodiment will be described using FIGS. 1 to 6. Incidentally, in this embodiment, the case where a developing device is applied to a full-color printer of a tandem type as an example of an image forming apparatus is described.

[Image Forming Apparatus]

First, a schematic structure of an image forming apparatus 100 will be described using FIG. 1.

Figure 1:
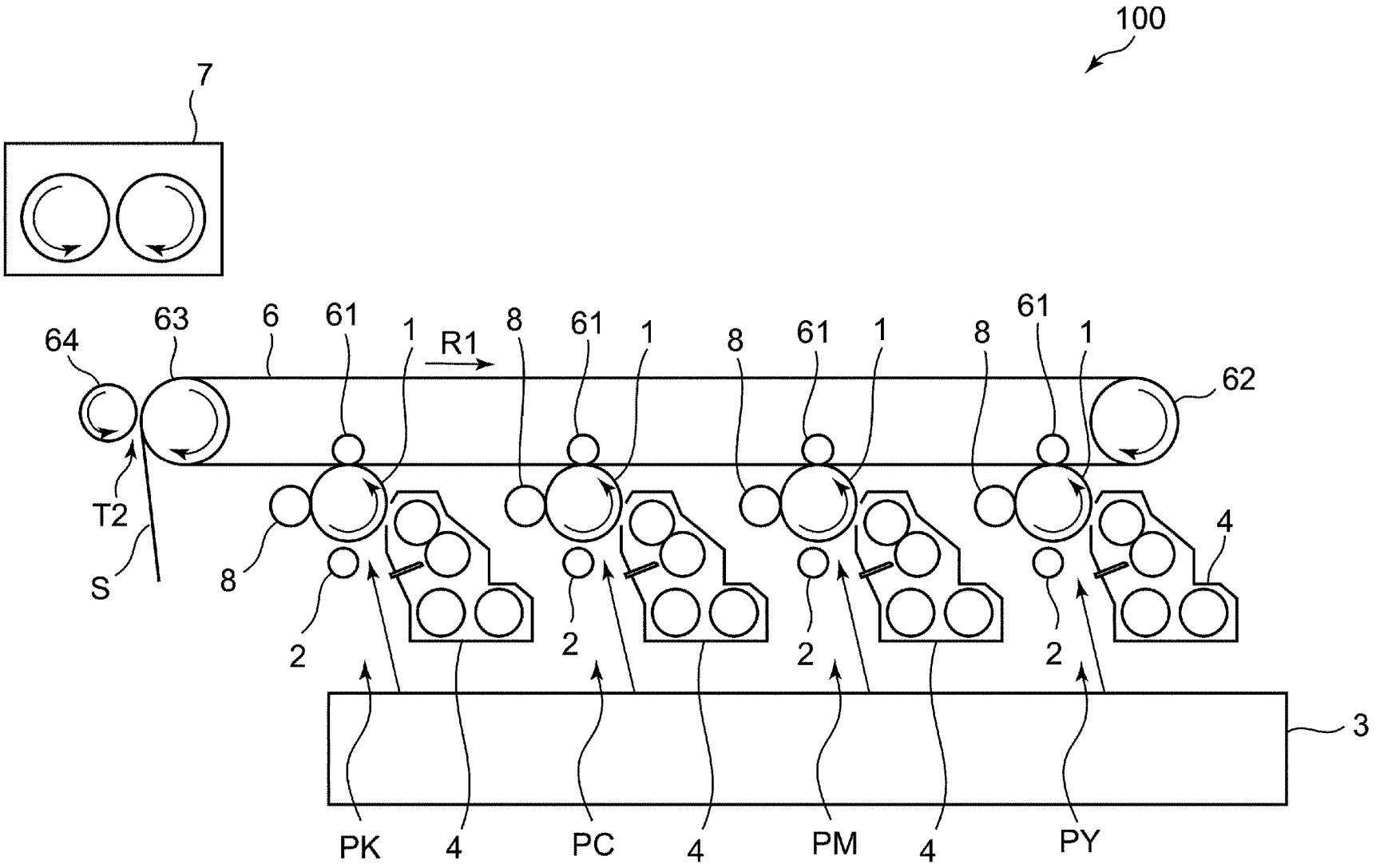
FIG. 1 is a schematic structural sectional view of an image forming apparatus in a first embodiment.

The image forming apparatus 100 shown in FIG. 1 is a full-color printer of an electrophotographic type including image forming portions PY, PM, PC and PK for four colors (yellow, magenta, cyan and black, respectively) in an apparatus main assembly. In this embodiment, an intermediary transfer tandem type in which the image forming portions PY, PM, PC, and PK are disposed along a rotational direction of an intermediary transfer belt 6 described later is employed. The image forming apparatus 100 forms a toner image (image) on a recording material S depending on an image signal from a host device such as a personal computer connected communicatably to the apparatus main assembly or to an unshown original reading device connected to the apparatus main assembly. As the recording material S, it is possible to cite a sheet material such as a sheet, a plastic film, or a cloth.

A toner image forming process will be described. First, the image forming portions PY, PM, PC and PK, will be described. The image forming portions PY, PM, PC and PK are constituted substantially the same except that colors of toners are different from each other so as to be yellow, magenta, cyan and black, respectively. Therefore, in the following, the image forming portion PY for yellow will be described as an example, and other image forming portions PM, PC and PK will be omitted from description.

The image forming portion PY is constituted principally by the photosensitive drum 1, a charging device 2, a developing device 4, a cleaning device 8, and the like. In this embodiment, the intermediary transfer belt 6 is provided above the image forming portions PY, PM, PC and PK, and an exposure device 3 is provided below the image forming portions PY, PM, PC and PK. The photosensitive drum 1 as an image bearing member and a photosensitive member includes a photosensitive layer formed on an outer peripheral surface of an aluminum cylinder so as to have a negative charge polarity or a positive charge polarity, and is rotated at a predetermined process speed (peripheral speed).

The charging device 2 electrically charges the surface of the photosensitive drum 1 to, e.g., a uniform negative or positive dark-portion potential depending on a charging characteristic of the photosensitive drum 1. In this embodiment, the charging device 2 is a charging roller rotatably in contact with the surface of the photosensitive drum 1. After the charging, at the surface of the photosensitive drum 1, an electrostatic latent image is formed on the basis of image information by the exposure device (laser scanner) 3. The photosensitive drum 1 carries the formed electrostatic image and is circulated and moved, and the electrostatic latent image is developed with the toner by the developing device 4. Details of a structure of the developing device 20 will be described later. The toner in the developer consumed by image formation is supplied together with a carrier from an unshown toner cartridge.

The toner image developed from the electrostatic latent image is supplied with a predetermined pressing force and a primary transfer bias by a primary transfer roller 61 provided opposed to the photosensitive drum 1 through the intermediary transfer belt 6, and is primary-transferred onto the intermediary transfer belt 6. The surface of the photosensitive drum 1 after the primary transfer is discharged by an unshown pre-exposure portion. The cleaning device 8 removes a residual matter such as transfer residual toner remaining on the surface of the photosensitive drum 1 after the primary transfer.

The intermediary transfer belt 6 is stretched by a stretching roller 62 and an inner secondary transfer roller 63. The intermediary transfer belt 6 is driven so as to be moved in an angle R1 direction in FIG. 1 by the inner secondary transfer roller 63 which is also driving roller. The image forming processes for the respective colors performed by the above-described image forming portions PY, PM, PC and PK are carried out at timings each when an associated color toner image is superposed on the upstream color toner image primary-transferred on the intermediary transfer belt 6 with respect to a movement direction of the intermediary transfer belt 6. As a result, finally, a full-color toner image is formed on the intermediary transfer belt 6 and is conveyed toward a secondary transfer portion T2. The secondary transfer portion T2 is a transfer nip formed by an outer secondary transfer roller 64 and a portion of the intermediary transfer belt 6 stretched by the inner secondary transfer roller 63. Incidentally, the transfer residual toner after passing through the secondary transfer portion T2 is removed from the surface of the intermediary transfer belt 6 in an unshown belt cleaning device.

Relative to the toner image forming process of the toner image sent to the secondary transfer portion T2, at a similar timing, a conveying (feeding) process of the recording material S to the secondary transfer portion T2 is executed. In this conveying process, the recording material S is fed from an unshown sheet cassette or the like and is sent to the secondary transfer portion T2 in synchronism with the image formation timing. In the secondary transfer portion T2, a secondary transfer voltage is applied to the inner secondary transfer roller 63.

By the image forming process and the conveying process which are described above, in the secondary transfer portion T2, the toner image is secondary-transferred from the intermediary transfer belt 6 onto the recording material S. Thereafter, the recording material S is conveyed to a fixing device 7, and is heated and pressed by the fixing device 7, so that the toner image is melted and fixed on the recording material S. Thus, the recording material S on which the toner image is fixed is discharged on a discharge tray by a discharging roller.

[Controller]

The image forming apparatus 100 includes a controller 20 for carrying out various pieces of control such as the above-described image forming operation and the like. Operations of respective portions of the image forming apparatus 100 are controlled by the controller 20 provided in the image forming apparatus 100. A series of the image forming operations is controlled by an operating portion at an upper portion of the apparatus main assembly or by the controller 20 in accordance with respective image forming signals via a network.

Figure 2:
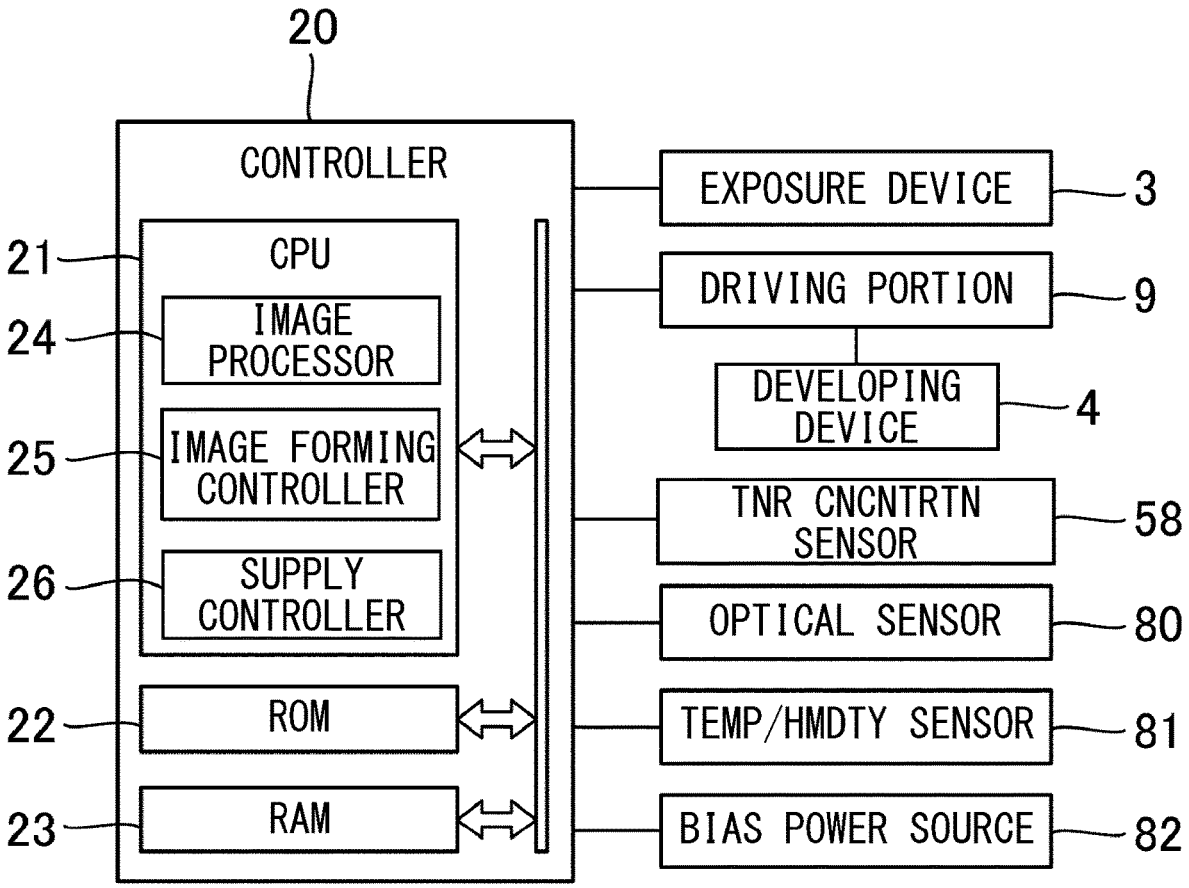
FIG. 2 is a control black diagram of the image forming apparatus in the first embodiment.

As shown in FIG. 2, the controller 20 includes a CPU (Central Processing Unit) 21 as a calculation control means, ROM (Read Only Memory) 22, a RAM (Random Access Memory) 23, and the like. The CPU 21 controls the respective portions of the image forming apparatus 100 while reading a program corresponding to a control procedure stored in the ROM 22. In the RAM 23, operation data and input data are stored, and the CPU 21 carries out control on the basis of the above-described program or the like by making reference to the data stored in the RAM 23.

The controller 20 generates driving signals of the respective portions by processing image information by an image processing portion 24 and controls the operations of the respective portions such as a driving portion 9 for driving the exposure device 3 and the developing device 4 by an image formation controller 25, and thus carries out toner supply control to the developing device 4 by the supply controller 26. The driving portion 9 includes a driving motor for driving a developing roller 50, a supplying roller 51, a first feeding screw 44, and a second feeding screw 45 which are described later.

To the controller, a toner concentration sensor 58, an optical sensor 80, a temperature and humidity sensor 81, a bias power source 82, and the like are connected. The toner concentration sensor 58 will be described later. The optical sensor 80 is disposed so as to oppose the surface of the intermediary transfer belt 6 and detects a density of a patch image which is a control toner image formed on the intermediary transfer belt 6. Depending on the density of the patch image detected by the optical sensor 80, the supply control of the toner to the developing device 4 and the like are carried out. The bias power source 82 is a power source for applying voltages to the developing roller 50 and the supplying roller 51 as described later.

The temperature and humidity sensor 81 is provided as an example of a detecting means, for example, at a part of a wall portion of a stirring chamber 43 on a downstream side of a toner conveying (feeding) direction in order to detect information on a temperature and a humidity in the developing device 4. A controller 20 calculates an absolute water content in the developing device 4 on the basis of the information, on the temperature and the humidity in the developing device 4, which is a detection result of the temperature and humidity sensor 81. That is, the temperature and humidity sensor 81 detects information on the absolute water content inside a developing container 40. Incidentally, in this embodiment, the controller 20 calculates information on a volume absolute humidity as the information on the absolute water content. Further, in this embodiment, the case where the controller 20 calculates the information on the volume absolute humidity as the information on the absolute water content was described, but the present invention is not limited to this, but the controller 20 may calculate information on a weight absolute humidity as the information on the absolute water content.

[Two-Component Developer]

Next, the developer used in this embodiment will be described. In this embodiment, as the developer, a two-component developer which contains non-magnetic toner particles (toner) and magnetic carrier particles (carrier) and which has a mixing coating ratio, of the toner on the carrier, of 8.0 weight % is used. The toner is colored resin particles containing a binder resin, a colorant, and other additives as desired, and onto a surface thereof, an external additive such as colloidal silica fine powder is externally added. The toner used in this embodiment is, for example, a negatively chargeable or positively chargeable polyester resin material depending on a charging characteristic of the photosensitive drum 1 and is about 7.0 μm in volume-average particle size. The carrier used in this embodiment comprises, for example, magnetic metal particles of, for example, iron, nickel, cobalt or the like, of which surface is oxidized, and is about 40 μm or more and about 50 μm or less in volume average particle size.

[Developing Device]

Figure 3:
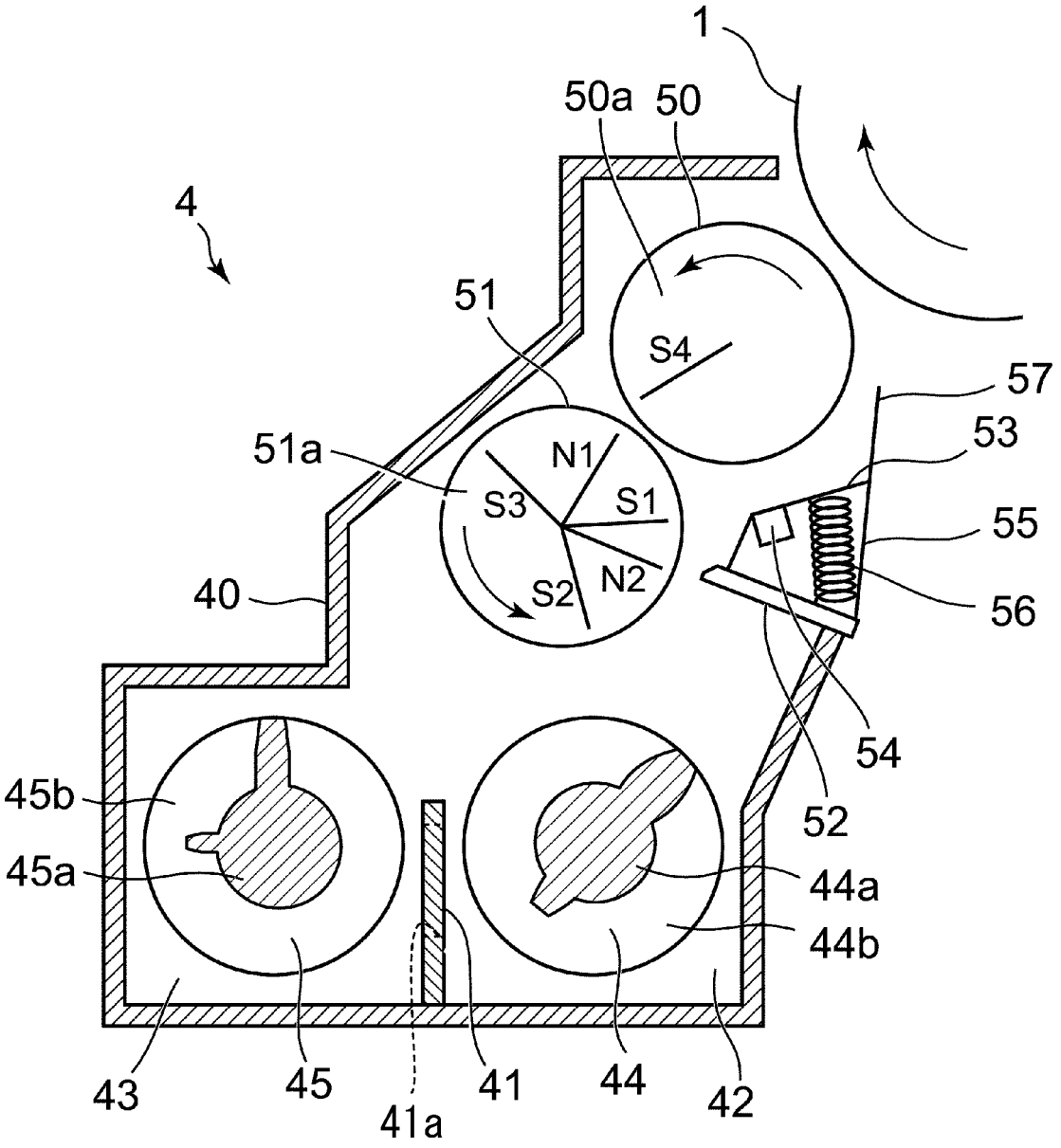
FIG. 3 is a sectional view of a developing device according to the first embodiment.

Next, the developing device 4 will be specifically described using FIG. 3. The developing device 4 of this embodiment is a developing device of a so-called touch-down developing type in which a thin layer of only the toner is formed on the developing roller 50 with a magnetic brush by the two-component developer formed on the supplying roller 51 and then development is carried out by causing the toner onto the electrostatic latent image formed on the photosensitive drum 1 by a developing bias, obtained by superimposing a DC and an AC, which is applied to the developing roller 50.

As shown in FIG. 3, the developing device 4 includes the developing container 40, the developing roller 50 as the rotatable developing member, and the supplying roller 51 as the rotatably supplying member. In the developing container 40, the developer containing the non-magnetic toner and the magnetic carrier is accommodated. The developing container 40 includes a developing chamber 42 as a first chamber, a stirring chamber 43 as a second chamber, and a partition wall 41 as a partitioning wall. The stirring chamber 43 is disposed adjacent to the developing chamber 42 so as to overlap at least partially with the developing chamber 42 as viewed in a horizontal direction. The partition wall 41 partitions between the developing chamber 42 and the stirring chamber 43. The partition wall 41 is provided with an opening 41*a* as a communicating portion for establishing communication between the developing chamber 42 and the stirring chamber 43 on each of opposite end sides with respect to a longitudinal direction (rotational axis direction of the developing roller 50 and the supplying roller 51). The developing device 4 forms a circulation passage along which the developer is circulated between the developing chamber 42 and the stirring chamber 43 via the opening 41*a* provided in the partition wall 41.

In this embodiment, the partition wall 41 is provided at a substantially central portion in the developing container 40. By this, the developing device 4 is partitioned by the partition wall 41 so that the developing chamber 42 and the stirring chamber 43 are adjacent to each other in the horizontal direction. In the developing chamber 42 and the stirring chamber 43, a first feeding screw 44 and a second feeding screw 45 which are rotatable are provided for stirring and circulating the developer.

The first feeding screw 44 as a first feeding member is disposed opposed substantially parallel to the supplying roller 51 along the rotational axis direction (longitudinal direction) of the supplying roller 51 at a bottom in the developing chamber 42 (in the first chamber). The first feeding screw 44 includes a rotation shaft 44*a* and a blade 44*b* provided helically at a periphery of the rotation shaft 44*a*. The second feeding screw 45 as a second feeding member is disposed opposed substantially parallel to the first feeding screw 44 at a bottom in the stirring chamber 43 (in the second chamber). The second feeding screw 45 includes a rotation shaft 45*a* and a blade 45*b* provided helically at a periphery of the rotation shaft 45*a*.

The first feeding screw 44 and the second feeding screw 45 are rotated in an arrow R4 direction and an arrow R3 direction, respectively, so that the developer is fed in the developing chamber 42 and the stirring chamber 43, respectively. The developer fed by rotation of the first feeding screw 44 and the second feeding screw 45 is circulated between the developing chamber 42 and the stirring chamber 43 through the opening 41*a* at each of opposite end portions of the partition wall 41. The toner is stirred by the first feeding screw 44 and the second feeding screw 45, whereby the toner is triboelectrically charged to a negative polarity or a positive polarity by friction with the carrier.

In the stirring chamber 43, a toner concentration sensor 58 (FIG. 2) is provided facing the second feeding screw 45. As the toner concentration sensor 58, for example, a permeability sensor for detecting permeability of the developer in the developing container 40 is used. On the basis of the detection result of the toner concentration sensor 58, the controller 20 causes the toner cartridge to supply the toner to the stirring chamber 43 through a toner supply opening (not shown).

As shown in FIG. 3, the developing roller 50 and the supplying roller 51 are disposed above the developing chamber 42 and the stirring chamber 43 with respect to a vertical direction. The developing roller 50 is provided obliquely on the supplying roller 51 between the supplying roller 51 and the photosensitive drum 1 as viewed in the rotational axis direction of the supplying roller 51. The supplying roller 51 and the developing roller 50 are disposed opposed to each other in an opposing portion P1 with rotational axes thereof substantially parallel to each other. The developing roller 50 opposes the photosensitive drum 1 on an opening side of the developing container 40. Each of the developing roller 50 and the supplying roller 51 is provided rotatably about the rotational axis thereof. Each of the developing roller 50 and the supplying roller 51 is rotationally driven in a counterclockwise direction (arrow B6 direction or arrow R5 direction) by a driving portion 9 (FIG. 2). That is, the developing roller 50 and the supplying roller 51 are rotated in the directions opposite to each other in the opposing portion P1, and rotational speeds thereof are made variable by the driving portion 9.

The supplying roller 51 is a non-magnetic cylindrical roller (with a diameter of, for example, 20 mm or more and 25 mm or less (20 mm in this embodiment)) rotatable in the counterclockwise direction in FIG. 3, and is provided rotatably at a periphery of a non-rotational cylindrical magnet roller 51*a* which is provided on an inner peripheral side and which is a magnetic field generating means and a second magnet. That is, the magnet roller 51*a* is non-rotationally fixed and disposed inside the supplying roller 51. The magnet roller 51*a* includes 5 pieces including, on a surface thereof opposing the supplying roller 51, a scooping pole S2, a regulating pole N2, a holding pole S1, a main pole N1, and a peeling pole S3 in a named order with respect to the rotational direction of the supplying roller 51. Incidentally, in this embodiment, the magnet roller having the 5 poles is used, but a magnet roller having poles other than the 5 poles, and for example, a magnet roller having 7 poles may also be used.

The main pole N1 is disposed in a position where the supplying roller 51 opposes the developing roller 50 and is different in polarity from a receiving pole S4, described later, of the magnet roller 51*a* in the developing roller 50. The holding pole S1 is disposed upstream of and adjacent to the main pole N1 with respect to the rotational direction of the supplying roller 51 and is different in polarity from the main pole N1. The regulating pole N2 is disposed in a position which is upstream of and adjacent to the holding pole S1 and where the regulating blade 52 described later opposes the supplying roller 51, and is the same in polarity as the main pole N1. The scooping pole S2 is disposed upstream and adjacent to the regulating pole N2 and is different in polarity from the regulating pole N2, and is a magnetic pole for scooping the developer from the developing container 40 to the supplying roller 51. Specifically, the scooping pole S2 is disposed opposed to the first feeding screw 44 at an upper portion of the developing chamber 42. The peeling pole S3 is disposed upstream of and adjacent to the scooping pole S2 with respect to the rotational direction of the supplying roller 51 and is the same in polarity as the scooping pole S2. The scooping pole S2, the regulating pole N2, the holding pole S1, the main pole N1, and the peeling pole S3 are disposed adjacent to each other in a named order with respect to the rotational direction of the supplying roller 51.

The supplying roller 51 carries the developer containing the non-magnetic toner and the magnetic carrier and rotationally conveys the developer to the opposing portion P1 to the developing roller 50. That is, the supplying roller 51 is disposed opposed to the developing roller 50 and supplies the developer inside the developing container 40 to the developing roller 50. The supplying roller 51 has a cylindrical shape of, for example, 20 mm in this embodiment, and is constituted by a non-magnetic material such as aluminum or non-magnetic stainless steel, and is formed in this embodiment by aluminum. Further, the supplying roller 51 is subjected to blasting so that an outer peripheral surface thereof has surface roughness of, for example, Rz=30 μm.

The regulating blade 52 as a regulating member is disposed upstream, with respect to the rotational direction of the supplying roller 51, of a position where the supplying roller 51 opposes the developing roller 50, and regulates an amount of the developer carried on the supplying roller 51. That is, the regulating blade 52 is a plate-like member and is provided in the developing container 40 so that a free end thereof opposes the outer peripheral surface of the supplying roller 51 in which the regulating pole N2 of the magnetic roller 51*a* is disposed. A predetermined gap is provided between the free end of the regulating blade 52 and the supplying roller 51. Further, a magnetic chain of the developer carried on the surface of the supplying roller 51 is cut by the regulating blade 52, so that a layer thickness of the developer is regulated. Specifically, the regulating blade 52 comprises a metal plate (for example, stainless steel plate) disposed along the longitudinal direction of the supplying roller 51, and the developer passes through between a free end portion of the regulating blade 52 and the supplying roller 51, so that the developer is conveyed in a state in which the amount of the developer is regulated at a certain amount. The regulating blade 52 is formed in an L-shape with a magnetic member such as SUS430 with a thickness of, for example, about 1.5 mm, and is fixed in the developing container 40 so as to extend in the rotational axis direction of the supplying roller 51.

Incidentally, the regulating blade 52 may be either of a magnetic (material) member or a non-magnetic member (material). In the case of the magnetic material, there is an advantage such that an interval between the free end of the regulating blade 52 and the supplying roller 51 can be made large, and thus a foreign matter is not readily clogged. On the other hand, in the case of the magnetic material, there is a liability that the developer is constrained by the magnetic field between the free end potion of the regulating blade 52 and the supplying roller 51 and thus a developer deterioration due to friction is liable to occur. Incidentally, a constitution in which the regulating blade 52 is a magnetic member which is applied to a part of the non-magnetic member may be employed. By doing so, the advantage of the magnetic member is somewhat lost, but it is possible to suppress the developer deterioration. In this embodiment, as the regulating blade 52, a regulating blade consisting only of a magnetic member was used. For that reason, there is a liability of the developer deterioration, but it becomes possible to suppress the developer deterioration by using the magnet roller 51*a* described later in this embodiment in combination.

The developer accommodated in the developing chamber 42 is attracted to the surface of the supplying roller 51 by the scooping magnetic pole S2 opposing developing chamber 42 and is conveyed toward the regulating blade 52. The developer is erected by the regulating magnetic pole N2 opposing the regulating blade 52, and a layer thickness thereof is regulated by the regulating blade 52. The developer layer passes through the holding pole S1, and is carried and conveyed to the opposing photosensitive drum 1 and then supplies the toner to the surface of the developing roller 50 in a state in which the magnetic chains are formed by the main pole N1 opposing the developing region by Vmag (DC component) applied to the supplying roller 51, Vslv (DC component), and a magnetic field. To the supplying roller 51, a supplying bias (Vmag) in the form of superimposition of a DC voltage and an AC voltage is applied.

The developing roller 50 is disposed opposed to the photosensitive drum 1 and conveys the developer to a developing position where the electrostatic latent image formed on the photosensitive drum 1 is developed by rotation of the developing roller 50. That is, the developing roller 50 is a non-magnetic roller rotatable in the counterclockwise direction in FIG. 3 and is provided rotatably around the magnet roller 50*a* as a first magnet which includes a single receiving pole S4 provided on an inner peripheral surface side and which does not rotate. The developing roller 50 is capable of developing the electrostatic latent image on the photosensitive drum 1 in the developing region which is an opposing region to the photosensitive drum 1 by being rotated while carrying the toner. The supplying roller 51 and the developing roller 50 oppose each other in the opposing portion P1 with a predetermined gap. The receiving pole S4 of the magnet roller 50*a* of the developing roller 50 is different in polarity from the main pole N1 opposing the receiving pole S4.

That is, a toner layer thickness of the toner on the developing roller 50 changes depending on a resistance of the developer, a difference in rotational speed between the supplying roller 51 and the developing roller 50, or the like, but can be controlled by ΔV. When &V&D is made large, the toner layer thickness becomes thick, and when ΔV is made small, the toner layer thickness becomes thin.

A range of ΔV during development may appropriately be about 100 V or more and about 350 V or less. A thin toner layer formed on the developing roller 50 by contact thereof with the magnetic brush on the supplying roller 51 is conveyed to an opposing region between the photosensitive drum 1 and the developing roller 50 by rotation of the developing roller 50.

To the developing roller 50, a developing bias (Vslv) in the form of superimposition of a DC voltage and an AC voltage is applied, and therefore, the toner is caused to fly from the developing roller 50 onto the photosensitive drum 1 by a potential difference between itself and a surface potential of the photosensitive drum 1, so that the electrostatic latent image on the photosensitive drum 1 is developed.

The developing bias and the supplying bias are applied from a bias power source 82 (FIG. 2) as an example of a voltage applying portion to the developing roller 50 and the supplying roller 51, respectively through a bias control circuit.

That is, the bias power source 82 applies a voltage including a DC component and an AC component to between the developing roller 50 and the supplying roller 51.

Toner remaining on the developing roller 50 without being used for the development is conveyed again to the opposing portion P1 between the developing roller 50 and the supplying roller 51 and is rubbed with the magnetic chains on the supplying roller 51, thus being collected by the supplying roller 51. The magnetic chains are peeled off from the supplying roller 51 in a peeling region formed by repulsion of the peeling pole S3 and the scooping pole S3 which are disposed on the downstream side of the rotational direction of the supplying roller 51. The developer peeled off falls in the developing chamber 42, and is stirred and fed together with the developer circulated inside the developing chamber 40 and is attracted to the scooping pole S2 again, and then is conveyed by the supplying roller 51.

[Collection of Deposited Toner]

In the case of the developing device 4 of this embodiment as described above, in the opposing portion between the developing roller 50 and the supplying roller 51, only the toner is carried on the developing roller 50 by the magnetic brush formed on the supplying roller 51, and further, the toner which is not used for the development is peeled off from the developing roller 50. For this reason, toner scattering is liable to occur in the neighborhood of the opposing portion between the developing roller 50 and the supplying roller 51. Further, when the toner floating in the developing device is deposited in the periphery of the regulating blade 52 and is aggregated and deposited on the developing roller 50, there is a liability that an image defect occurs due to a so-called toner dropping such that the aggregated toner is outputted onto the image.

Therefore, in this embodiment, a toner receiving member 53 and a vibration motor 54 are provided. The toner receiving member 53 is disposed below the developing roller 50, and the regulating blade 52 is inclined downward toward a position where the regulating blade 52 opposes the supplying roller 51. In this embodiment, the toner receiving member 53 is disposed above the regulating blade 52 along a longitudinal direction and receives the toner dropping from the developing roller 50. The vibration motor 54 as a vibration generating means vibrates the toner receiving member 53. Further, in this embodiment, an operation in a mode image during non-image formation, the supplying roller 51 rotated in a direction opposite to the rotational direction thereof during image formation is executable. In the operation in this mode, not only the vibration motor 54 is vibrated during the non-image formation but also the supplying roller 51 is rotated in the direction opposite to the rotational direction thereof during the image formation. By this, the deposited toner is collected by the magnetic brush on the supplying roller 51, so that deposition of the toner at a periphery of the regulating blade 52 is effectively suppressed. In the following, description thereof will be specifically made.

As shown in FIG. 3, in the neighborhood of the developing roller 50 on a right-side wall of the developing container 40 in FIG. 3, a toner receiving member supporting member 55 projecting toward an inside of the developing container 40 is provided. The toner receiving member supporting member 55 is disposed along a longitudinal direction (direction perpendicular to the drawing sheet surface of FIG. 3) of the developing container 40, and an upper surface of the toner receiving member supporting member 55 not only opposes the supplying roller 51 and the developing roller 50 but also constitutes a wall portion inclined downward from the developing roller 50 toward the supplying roller 51. On the upper surface of the toner receiving member supporting member 55, along the longitudinal direction, the toner receiving member 53 for receiving the toner peeled off and dropping from the developing roller 50 is mounted.

The toner receiving member 53 is made of a metal plate and is supported by the toner receiving member supporting member 55 through two coil spring 56 provided on each of opposite sides with respect to the longitudinal direction. Further, at a central portion of the toner receiving member 53 with respect to the longitudinal direction, the vibration motor 54 is supported. Onto the surface of the toner receiving member 53, a sheet member is applied. In order to suppress deposition of the toner onto the toner receiving member 53, the sheet member is formed of a material on which the toner is not readily deposited on the sheet member more than on the toner receiving member 53. As the material of the surface member, for example, a fluorine-containing resin sheet can be cited.

Further, at an upper end of the toner receiving member supporting member 55, a film-like seal member 57 is provided. The seal member 57 extends in a longitudinal direction (direction perpendicular to the drawing sheet surface of FIG. 6) so that a free end portion thereof contacts the surface of the photosensitive drum 1 (in FIG. 2, a contact portion is omitted from illustration), and has a function of sealing the contact portion so that the toner in the developing container 40 leaks out to an outside of the developing container 40.

The vibration motor 54 includes an output shaft to which a vibration weight is fixed. The vibration motor 54 is fixed so that the output shaft extends along the longitudinal direction of the toner receiving member 53. The vibration weight has a cam shape such that the vibration weight is asymmetrical with respect to the output shaft. When the output shaft rotates at a predetermined speed or more, non-uniform centrifugal force is applied to the vibration weight. This centrifugal force is transmitted to the output shaft, whereby the vibration motor 54 vibrates. Incidentally, the shape of the vibration weight is not limited to the cam shape, but can be made an arbitrary shape such that the center of gravity is shifted from the output shaft.

During drive of the developing device 4, the output shaft of the vibration motor 54 is rotated at a high speed (for example, about 10,000 rpm), whereby the vibration weight is also rotated together with the output shaft at a high speed. At this time, the non-uniform centrifugal force is applied to the vibration weight, and therefore, the vibration motor 54 vibrates through the output shaft. Further, the toner receiving member 53 to which the vibration motor 54 is fixed also vibrates. By the vibration of the toner receiving member 53, the toner deposited on the toner receiving member 53 is separated and shaken down. By this, even in the case where the supplying roller 51 and the developing roller 50 in the developing device 4 are rotated at high speeds and thus a toner floating amount is large, the deposition of the toner on the toner receiving member 53 can be suppressed.

Figure 4:
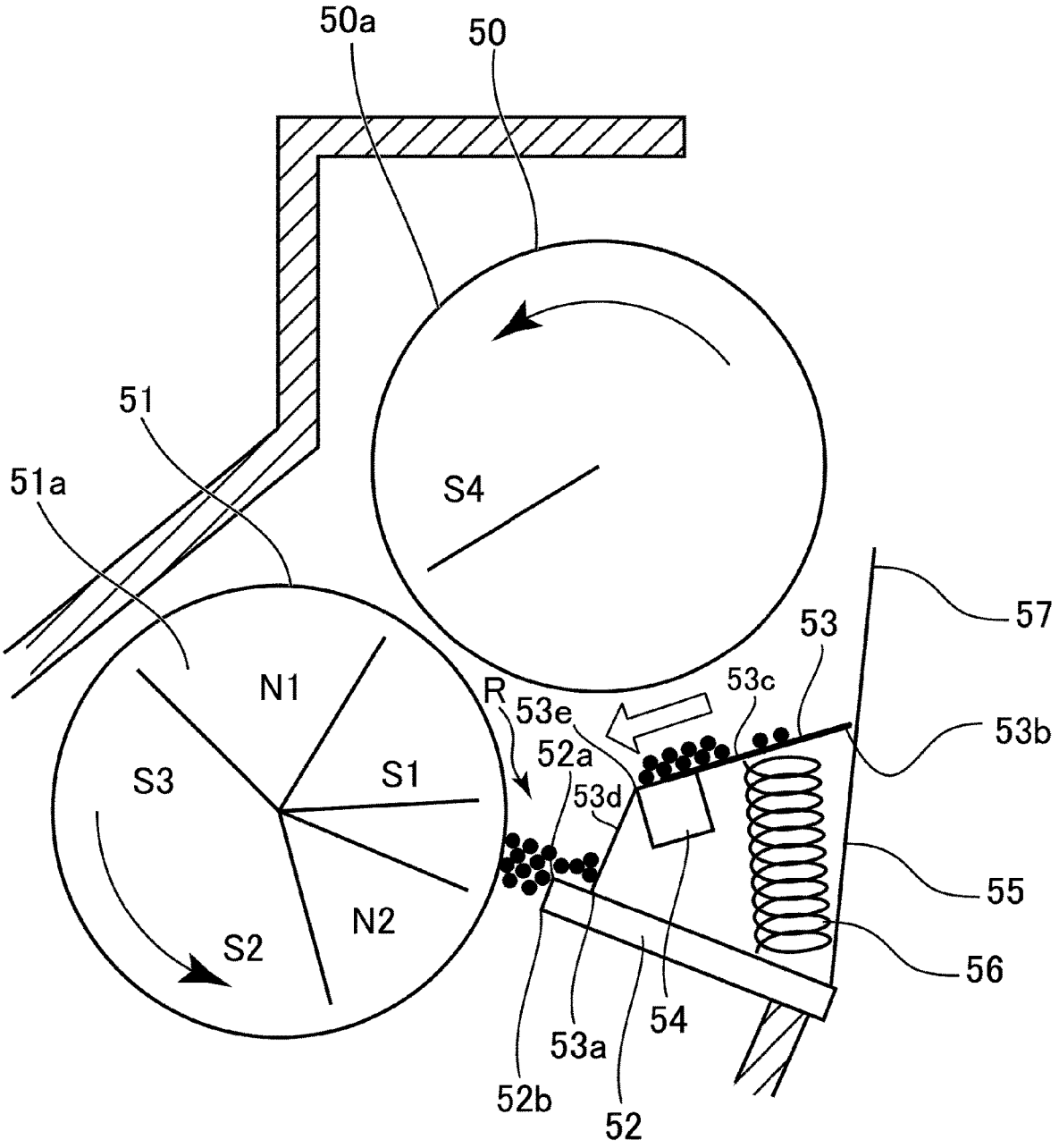
FIG. 4 is an enlarged sectional view of a toner receiving member and a periphery thereof in the first embodiment.

A structure of the periphery of the toner receiving member 53 will be specifically described using FIG. 4. The toner receiving member 53 contacts the toner receiving member supporting member 55 only at an edge 53*a* thereof on the supplying roller 51 side, and an edge 53*b* thereof on an opposite side (photosensitive drum 1 side) is a free end. Further, a substantially central portion of the toner receiving member 53 with respect to a widthwise direction (left-right direction of FIG. 4) is supported by the toner receiving member supporting member 55 through the coil springs 56. By this, the toner receiving member 53 is constituted so as to be swingable about the edge 53*a* as a supporting point.

Further, the toner receiving member 53 is disposed so that a toner receiving surface 53*c* opposing the developing roller 50 is inclined with an upward slope from the supplying roller 51 side toward the photosensitive drum 1 side and so that a toner dropping surface 53*d* opposing the supplying roller 51 is substantially perpendicular to the regulating blade 52.

When the vibration motor 54 is vibrated during the non-image formation, the toner receiving member 53 is vibrated so that an amplitude of the vibration becomes large toward the edge 53*b* with the edge 53*a* as the supporting point. By the vibration of the toner receiving member 53, as shown in FIG. 4, the toner deposited on the toner receiving surface 53*c* of the toner receiving member 53 slides downward (in an arrow direction of FIG. 4) along inclination of the toner receiving surface 53*c* and then falls in a region G sandwiched between the toner dropping surface 53*d* and the supplying roller 51.

As a timing when the toner receiving member 53 is vibrated and a timing when the supplying roller 51 is rotated in the opposite direction, i.e., as a timing when the operation in the mode is executed, the operation may be performed every time when the image forming operation is ended or at a predetermined timing during the non-image formation such as a point of time when the number of sheets subjected to the image formation reaches a predetermined number or a point of time when a temperature in the developing device 4 reaches a predetermined temperature or more. Incidentally, the non-image formation refers to a time when the electrostatic latent image on the photosensitive drum 1 is not developed by the developing device 4. Accordingly, even during execution of an image forming job by an instruction, for example, a timing between consecutive two images (so-called sheet interval) is during the non-image formation, and the above-described operation in the mode may be executed in the sheet interval.

Further, the timing when the toner receiving member 53 is vibrated and the timing when the supplying roller 51 is rotated in the opposite direction may be the same as or different from each other. Further, the toner receiving member 53 is vibrated every time when the number of sheets subjected to the image formation reaches the predetermined number, whereby the vibration of the toner receiving member 53 may be automatically executed depending on the number of sheets subjected to the image formation or may be executed at a timing set automatically by a user.

Here, in order to return the toner dropped in the regulating R to the developing chamber 42, during the non-image formation, the supplying roller 51 is rotated in the opposite direction (clockwise direction of FIG. 3) to the rotational direction thereof during the image formation. By rotating the supplying roller 51 in the opposite direction, the toner dropped and deposited passes through the gap between the supplying roller 51 and the regulating blade 52 by being carried on the surface of the supplying roller 51 in the rotation of the supplying roller 51, and is forcedly returned to the developing chamber 42. At this time, the developing roller 50 is also rotated in the opposite direction to the rotational direction thereof during the image formation.

On the other hand, when the developing roller 50 and the supplying roller 51 are rotated in the opposite directions, there is a liability that the developer in the developing container 40 is leaked through a toner supplying opening or localized in the developing container 40 and thus noise of the toner concentration sensor 58 generates. For this reason, after the developing roller 50 and the supplying roller 51 are rotated in the opposite directions, it is preferable that the developing roller 50 and the supplying roller 51 are rotated in normal rotational directions which are the rotational directions during the image formation for a certain time.

Here, in the case where the developing roller 50 and the supplying roller 51 are rotated in the opposite directions (to the normal rotational directions), an effect of peeling off the toner deposited on the free end of the regulating blade 52 becomes high by adjusting the magnetic force and arrangement of the regulating pole N2 opposing the regulating blade 52 so that the chains of the magnetic brush formed on the supplying roller 51 become long.

Figure 5:
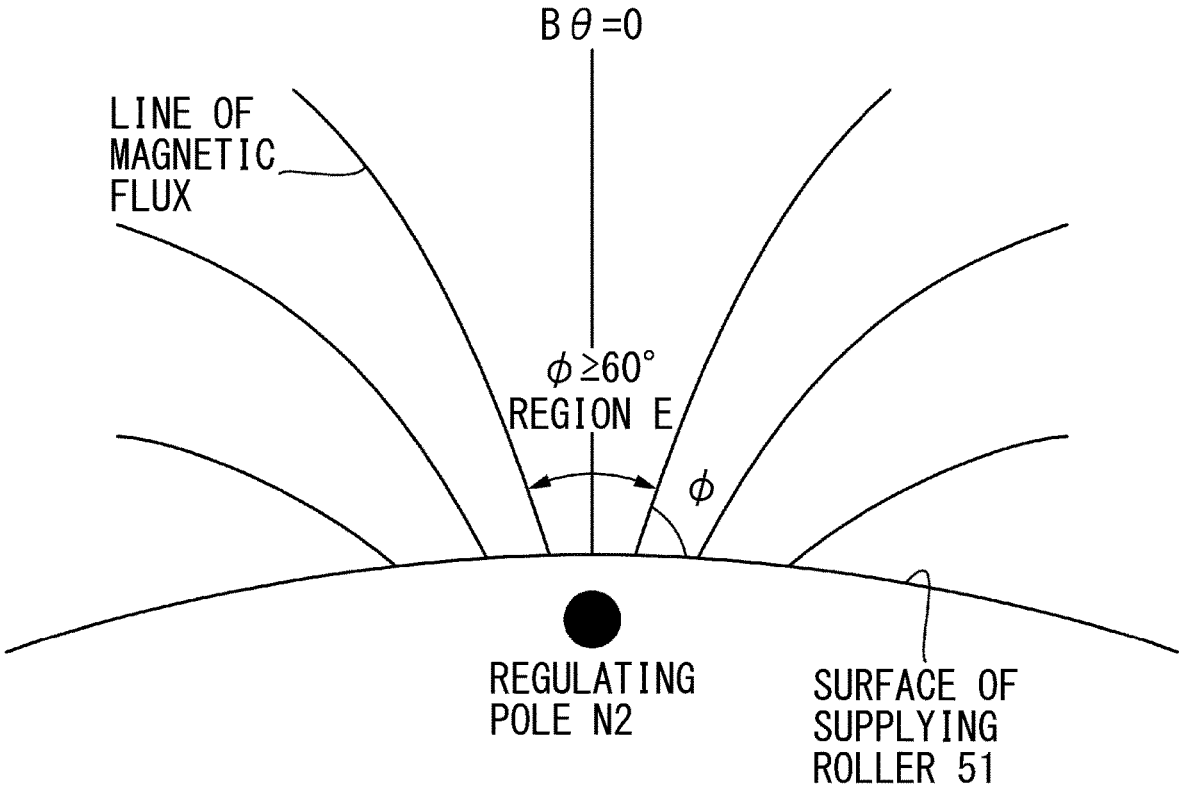
FIG. 5 is a schematic view for illustrating a line of magnetic flux, a magnetic chain (bristle), and an angle of (magnet roller) chain.

FIG. 5 is a schematic view showing lines of magnetic flux of the supplying roller 51 by the regulating pole N2 of the magnet roller 51*a* of the supplying roller 51. The lines of magnetic fluxes extend from the regulating pole N2 toward the adjacent scooping pole S2 and the adjacent holding pole S1 of the magnet roller 51*a*. Further, the magnetic brush is formed along the lines of magnetic fluxes. Accordingly, a position where the chain of the magnetic brush becomes longest in a normal direction to the surface of the supplying roller 51 is a position of a tangential direction component Bθ=0 of a magnetic flux density B to the supplying roller 51. That is, when an angle formed between the line of magnetic force and the supplying roller 51 is an angle of chain (line of magnetic flux) φ, the above-described position is a position when the angle of chain φ becomes 90° (degrees). At the position of Bθ=0 formed at the periphery of the regulating pole N2 of the magnet roller 51*a*, the chain of the magnetic brush becomes longest, so that the effect of peeling off the deposited toner becomes highest.

In the case where the angle of chain φ is 45° and 60°, a length of the magnetic brush from the surface of the supplying roller 51 in the normal direction becomes about 87% and about 71%, respectively compared with when the angle of chain φ is 90°. Further, the lines of magnetic flux are curved so as to lie down with a distance from the surface of the supplying roller 51, and therefore, the length of the chain of the magnetic brush from the surface of the supplying roller 51 in the normal direction becomes shorter than the above-described length. As the angle of chain φ lies down, the effect of peeling off the deposited toner by the chain of the magnetic brush lowers.

Therefore, in this embodiment, the position where the magnetic flux density Bθ of the regulating pole N2 in the tangential direction at the surface of the supplying roller 51 becomes 0 is positioned on a side downstream of an upstream end of the regulating blade 52 with respect to the normal rotational direction of the supplying roller 51 which is the rotational direction of the supplying roller 51 during the image formation. Further, the position where the magnetic flux density Bθ of the regulating pole N2 in the tangential direction at the surface of the supplying roller 51 becomes 0 is positioned on a side downstream of a downstream end of the regulating blade 52 with respect to the normal rotational direction. In the following this will be specifically described.

[Magnet Roller of Supplying Roller]

The magnetic pole N2 of the magnet roller 51*a* of the supplying roller 51 in each of embodiments 1-1 and 1-2 will be described with reference to parts (a) and (b) of FIG. 6 while being compared with a comparison example.

Part (a) of FIG. 6 is a graph schematically showing a distribution of the magnetic flux density Br of the magnet roller 51*a* on the supplying roller 51, and part (b) of FIG. 6 is a graph schematically showing a distribution of the magnetic flux density Bθ of the magnet roller 51*a* on the supplying roller 51. Incidentally, the magnetic flux density Br accurately refers to a normal direction component of the magnetic flux density B normal to the supplying roller 51, and the magnetic flux density Bθ in the normal direction refers to a tangential direction component of the magnetic flux density B tangential to the supplying roller 51.

The magnetic flux density Br of each of the magnet rollers (with respect to the normal direction) in the embodiments 1-1 and 1-2 and in the comparison example was measured using a magnetic field measuring device ("MS-9902", manufactured by F. W. BELL) in which a distance between a probe which is a member of the magnetic field measuring device and the surface of the supplying roller 51 is of about 100 μm. The magnetic flux density Bθ of each of the magnet rollers with respect to the tangential direction to the surface of the supplying roller 51 is acquired from the following formula 1 by using a value of Br measured by the above-described method.

$$B_\theta = -\frac{\partial A_z(r,\theta)}{\partial r}\left(A_z(R,\theta) = \int_0^\theta RB_r d\theta\right)$$

The magnetic flux density Bθ of the regulating pole N2 of the magnet roller 51*a* in each of the embodiments 1-1 and 1-2 will be specifically described based on parts (a) and (b) of FIG. 6 while being compared with the comparison example. In parts (a) and (b) of FIG. 6, the magnet roller 51*a* in this embodiment is used in each of the embodiment 1-1 (broken line) and the embodiment 1-2 (dotted line). Further, the comparison example is represented by a solid line.

Further, as shown in FIG. 4, a positional relationship between the upstream end 52*a* and the downstream end 52*b* of the free end of the regulating blade 52 on opposite sides with respect to the rotational direction of the supplying roller 51, a bonding portion 53*e* between the toner receiving surface 53*c* and the toner dropping surface 53*d*, and the magnetic flux density Bθ was also shown in parts (a) and (b) of FIG. 6. An arrow shown in parts (a) and (b) of FIG. 6 represents a developer feeding direction (the rotational direction (normal rotational direction) of the supplying roller 51).

As shown in part (b) of FIG. 6, according to the positional relationship between the magnetic flux density Bθ=0 of the regulating pole N2 and the upstream end 52*a* of the regulating blade 52 in the comparison example, the position of the magnetic flux density Bθ=0 when the chain of the magnetic brush most extends is positioned upstream of the upstream end 52*a* of the regulating blade 52 with respect to the normal rotational direction of the supplying roller 51. That is, a constitution in which the magnetic chain most extends in a developer regulating region is employed.

As described above, as the angle of chain φ lies down, collection efficiency of the deposited toner by the chains of the magnetic brush lowers. According to a study by the present inventor, when the angle of chain φ is 60° or more, the deposited toner is collected efficiently. As shown in FIG. 5, according to the magnetic flux density Br and the magnetic flux density Bθ in the comparison example, a region E in which the angle of chain φ is 60° or more is about ±9° with respect to a position of the angle of Bθ=0. That is, an angle difference of the region E in which the angle of chain φ is 60° or more falls within a range of an angle difference of 9° with respect to the position of the angle of Bθ=0.

In the case of the diameter (20 mm) of the supplying roller 51, the gap between the supplying roller 51 and the regulating blade 52, and the plate thickness of the regulating blade 52 in this embodiment, with respect to the normal rotational direction of the supplying roller 51, an angle difference between the downstream end 52*b* and the upstream end 52*a* of the regulating blade 52 are about 8°. Accordingly, an angle difference between the position of Bθ=0 of the regulating pole N2 and the downstream end 52*b* of the regulating blade 52 in the comparison example is about 10°, so that this angle difference (10°) is larger than the angle difference of 9° with respect to the position of Bθ=0 (center) where the angle of chain φ is 60° or more, and it is understood that the collection efficiency of the deposited toner in the region R is low.

Accordingly, in the case of the constitution of the comparison example, relative to an increase in toner scattering amount with speed-up of the image forming apparatus and formation of toner particles with a small diameter, the collection efficiency of the deposited toner by the operation in a mode in which the deposited toner is collected (deposited toner collecting mode) is low, and a frequency of the operation in this deposited toner collecting mode increases, so that a lowering in productivity is invited.

Next, the embodiments 1-1 and 1-2 will be described. In the embodiments 1-1 and 1-2, the magnetic flux density Br is the same in magnitude as in the comparison example, but the relationship between the regulating blade 52 and the magnetic flux density Bθ is constituted as follows so as to enhance the deposited toner collection efficiency.

As described above, in order to efficiently collect the deposited toner in the region R, the region which is formed by the regulating pole N2 and in which the angle of chain φ is 60° or more may preferably exist in the region R. Accordingly, in the embodiment 1-1, in a state in which the magnetic flux density Br formed by the regulating pole N2 is the same in magnitude as in the comparison example, with respect to the normal rotational direction of the supplying roller 51, the position of Bθ=0 is positioned at least on a side downstream of the upstream end 52*a* of the regulating blade 52.

In the embodiment 1-1, the position of Bθ=0 was positioned on a side downstream of the upstream end 52*a* with respect to the normal rotational direction by 2°. That is, the region which is formed by the regulating pole N2 and in which the angle of chain φ is 60° or more exists in the region R, so that the deposited toner collection efficiency by the operation in the deposited toner collecting mode is improved.

Further, in order to improve the deposited toner collection efficiency by the operation in the deposited toner collecting mode, in the positional relationship between the regulating blade 52 and the magnetic flux density Bθ=0, the position of the magnetic flux density Bθ=0 may preferably be positioned downstream of the downstream end 52*b* of the regulating blade 52 with respect to the normal rotational direction. This is because the position of Bθ=0 where the magnetic chain most extends exists in the region R with reliability, and the region in which the angle of chain is 60° or more exists over a wide range of the region R. In the embodiment 1-2, the position of Bθ=0 is positioned downstream of the downstream end 52*b* of the regulating blade 52 by 2°.

In the comparison example and the embodiments 1-1 and 1-2 which are described above, an evaluation test of an image defect due to toner dropping was conducted. An evaluation condition was such that a temperature of 30° C., a humidity of 80% RH, an image duty of 30%, a frequency of the operation in the deposited toner collecting mode is once per 100 sheets, and an image forming speed of 60 rpm, 80 rpm, and 100 rpm for the image forming apparatus. Evaluation was performed by eye observation of an outputted image in the following manner. The case where aggregate toner was outputted on the image, i.e., so-called toner dropping was not observed was evaluated as "○", the case where the toner dropping was slightly observed was evaluated as "Δ", and the case where the toner dropping was observed and the influence of the toner dropping on an image quality was large was evaluated as "x". An evaluation result is shown in a table 1.

TABLE 1

| Toner dropping test | 60 ppm | 80 ppm | 100 ppm |
|---|---|---|---|
| COMP. EX. | ○ | Δ | x |
| EMB. 1-1 | ○ | ○ | Δ |
| EMB. 1-2 | ○ | ○ | ○ |

As is apparent from the table 1, compared with the comparison example, in both of the embodiments 1-1 and 1-2, the deposited toner collection efficiency by the operation in the deposited toner collecting mode, so that it can be said that an image inconvenience due to the toner dropping was able to be suppressed while maintaining productivity.

Incidentally, the position of Bθ=0 formed by the regulating pole N2 may be set at a position on a side downstream of the upstream end 52*a* and the downstream end 52*b* of the regulating blade 52 with respect to the normal rotational direction in consideration of a production tolerance of the magnet roller 51*a* relative to the positions in the embodiments 1-1 and 1-2. That is, in the case where the production tolerance of Bθ=0 in the magnetic pole N2 of the magnet roller 51*a* is ±3°, as regards the position of Bθ=0, a position downstream of the upstream end 52*a* and the downstream end 52*b* with respect to the normal rotational direction by 3° may preferably be used as a center value.

Further, when the position of Bθ=0 formed by the regulating pole N2 is positioned on a side downstream of the bonding portion 53*e*, between the toner receiving surface 53*c* and the toner dropping surface 53*d*, which is a downstream end of the region R with respect to the normal rotational direction, the chain of the magnetic brush most extends in a region in which the deposited toner is not present, so that the deposited toner collection efficiency by the operation in the deposited toner collecting mode lowers. Accordingly, the position of Bθ=0 formed by the regulating pole N2 may preferably be positioned on a side upstream of the bonding portion 53*e* with respect to the normal rotational direction.

The position where the toner is most deposited in the region R is at the periphery of the downstream end 52*b* of the regulating blade 52. Further, as described above, in the region in which the collection efficiency is highest and in which the angle of chain φ is 60° or more, the angle difference with respect to the position of Bθ=0 as a center is about 9°. For this reason, the position of Bθ=0 may desirably fall within a range from the downstream end 52*b* of the regulating blade 52 toward a side downstream of the downstream end 52*b* with respect to the normal rotational direction by 10° or less.

Further, in this embodiment, as the regulating blade 52, the non-magnetic metal plate was employed. However, as the regulating blade 52, a magnetic metal plate such that the lines of magnetic flux extend from a position downstream of the regulating blade 52 toward the regulating blade 52 with respect to the normal rotational direction may also be employed. By this, an effect of collecting the toner dropped in the region R when the supplying roller 51 is rotated in the opposite direction can be enhanced.

Further, the relationship between the arrangement position of the regulating blade 52 and the magnetic flux density distribution is capable of being measured in the following manner. In general, the magnet roller 51*a* of the supplying roller 51 includes a shaft, and an end portion of the shaft has a so-called D-cut shape. The D-cut portion is fixed to the developing container so as to provide a desired magnetic pole arrangement. A distribution of the magnetic flux density Br of the magnet roller 51*a* relative to (flat plane angle of) the D-cut portion is capable of being measured by the above-described magnetic field measuring device. On the other hand, when arrangement (position) of the regulating blade 52 relative to a shaft center of the magnet roller 51*a* is measured, a relationship between the arrangement of the regulating blade 52 and the magnetic flux density distribution can be acquired. The arrangement of the regulating blade 52 relative to the shaft center of the magnet roller 51*a* may be acquired using a measuring tool such as a protractor, in the case where the arrangement is accurately acquired, a general-purpose three-dimensional measuring device (for example, "CRYSTA-Apex S series", manufactured by Mitsutoyo Corp.) may be used.

Further, in this embodiment, a constitution using the vibration motor 54 was employed, but also, in a constitution in which a vibration generating means such as the vibration motor 54 is not used, for example, due to toner scattering by falling of the magnetic brush chains after passing through the regulating pole N2, the toner is deposited in the region R. For this reason, the above-described constitution of the arrangement of the regulating blade 52 and the magnetic flux density distribution is also applicable to a constitution with no vibration generating means.

Second Embodiment

A second embodiment will be described using part (a) of FIG. 7 to FIG. 8 while making reference to FIGS. 3 and 4. In this embodiment, magnetic flux density distribution of the regulating pole N2 is made different from the first embodiment. Other constitutions and actions are similar to those in the first embodiment, and therefore, the similar constitutions are omitted from description and illustration or briefly described by adding the same reference numerals or symbols, and in the following, a difference from the first embodiment will be principally described.

Also, in the case of this embodiment, the position where the magnetic flux density Bθ of the regulating pole N2 in the tangential direction at the surface of the supplying roller 51 becomes 0 is positioned on a side downstream of an upstream end of the regulating blade 52 with respect to the normal rotational direction of the supplying roller 51 which is the rotational direction of the supplying roller 51 during the image formation. Further, preferably, the position where the magnetic flux density Bθ of the regulating pole N2 in the tangential direction at the surface of the supplying roller 51 becomes 0 is positioned on a side downstream of a downstream end of the regulating blade 52 with respect to the normal rotational direction.

On the other hand, in this embodiment, different from the first embodiment, the distribution of the magnetic flux density Br of the regulating blade pole N2 in the normal direction at the surface of the supplying roller 51 satisfies: $2 \geq X/Y > 1$, preferably $4 \geq X/Y > 1$ in the case where a position where the magnetic flux density Br becomes maximum is a first position (point A), a position on a side upstream of the first position and where the magnetic flux density Br becomes 0 is a second position (point B1), a position on a side downstream of the first position and where the magnetic flux density Br becomes 0 is a third position (point B2), an angle difference between the first position and the second position with respect to the normal rotational direction is X, and an angle difference between the first position and the third position with respect to the normal rotational direction is Y.

Part (a) of FIG. 7 is a graph schematically showing a distribution of the magnetic flux density Br of the magnet roller 51*a* on the supplying roller 51 in each of the comparison example, the embodiment 2-1, and the embodiment 2-2, and part (b) of FIG. 7 is a graph schematically showing a distribution of the magnetic flux density Bθ of the magnet roller 51*a* on the supplying roller 51 in each of the comparison example, the embodiment 2-1, and the embodiment 2-2.

Further, in parts (a) and (b) of FIG. 7, similarly as in parts (a) and (b) of FIG. 6, a positional relationship between the upstream end 52*a* and the downstream end 52*b* of the free end of the regulating blade 52 on opposite sides with respect to the rotational direction of the supplying roller 51, a bonding portion 53*e* between the toner receiving surface 53*c* and the toner dropping surface 53*d*, and the magnetic flux density Bθ, and the developer feeding direction (rotational direction of the supplying roller 51 (normal rotational direction), arrow direction) were also shown.

In the embodiments 2-1 and 2-2, the magnetic flux density Br is the same in magnitude as in the comparison example, but the relationship between the regulating blade 52 and the magnetic flux density Bθ is constituted as follows so as to enhance the deposited toner collection efficiency. In the embodiments 2-1 and 2-2, a difference from the embodiments 1-1 and 1-2 is that the shape of the magnetic flux density Br of the regulating pole N2 is made asymmetrical while the shape and a maximum value angle of the magnetic flux density Br of each of the scooping pole S2 and the holding pole S1 which are adjacent to the regulating pole N2, and a positional relationship between these magnetic poles and the regulating blade 52 are made the same as those in the comparison example.

Here, the asymmetrical shape of the magnetic flux density Br of the graph pole N2 in the embodiment 2-1 will be described using FIG. 8. FIG. 8 is an enlarged view of the magnetic flux density Br at the periphery of the regulating pole N2 in embodiment 2-1 shown in part (a) of FIG. 7. The point A is the position where the magnitude of the magnetic flux density Br in the normal direction becomes maximum. Each of the points B1 and B2 is the position (point) where the magnetic flux density Br becomes 0. With respect to the normal rotational direction, the point B1 is the position where the magnetic flux density Br becomes 0 on a side upstream of the point A, and the point B2 is a position where the magnetic flux density Br becomes 0 on a side downstream of the point A. X represents the angle difference between the point A and the point B1, and Y represents the angle difference between the point A and the point B2.

Specifically, in the embodiment 2-1, a ratio of the angle difference (Y) between the point A and the point B2 of the regulating pole N2 and the angle difference (X) between the point A and the point B1 of the regulating pole N2 is about 1:2. That is, $2 \geq X/Y > 1$ is satisfied. Incidentally, in the comparison example, a ratio of the angle difference between the point A and the point B2 of the regulating pole N2 and the angle difference between the point A and the point B1 of the regulating pole N2 is about 1:1.

In order to dispose the position of the magnetic flux density Bθ=0 on the side downstream with respect to the normal rotational direction, a maximum value of the magnetic flux density Br is positioned on the side downstream with respect to the normal rotational direction. In order to minimize the influence on the adjacent magnetic poles, the position of the magnetic flux density Br=0 is made the same as the position of the magnetic flux density Br=0 in the comparison example. Accordingly, by adjusting the ratio of the angle difference between the point A and the pair B2 of the regulating pole N2 to the angle difference between the point A and the point B1 of the regulating pole N2, the position of the magnetic flux density Bθ=0 can be changed while minimizing the influence on the adjacent magnetic poles.

According to the constitution of the embodiment 2-1, compared with the comparison example, the shape or the like of the magnetic flux density Br of the magnetic poles adjacent to the regulating pole N2, and therefore, the functions of other magnetic poles are not impaired. In addition, in the embodiment 2-1, the position of the magnetic flux density Bθ=0 is downstream of at least the upstream end 52*a* of the regulating blade 52 with respect to the normal rotational direction and is downstream of the upstream end 52*a* by 2° similarly as in the embodiment 1-1. That is, the region which is formed by the regulating pole N2 and in which the angle of chain φ is 60° or more exists in the region R, so that the deposited toner collection efficiency by the operation in the deposited toner collecting mode is improved, and becomes the same collection efficiency as in the embodiment 1-1.

Further, in order to improve the deposited toner collection efficiency by the operation in the deposited toner collecting mode, in the positional relationship between the regulating blade 52 and the magnetic flux density Bθ=0, the position of the magnetic flux density Bθ=0 may preferably be positioned downstream of the downstream end 52*b* of the regulating blade 52 with respect to the normal rotational direction. This is because the position of Bθ=0 where the magnetic chain most extends exists in the region R with reliability, and the region in which the angle of chain is 60° or more exists over a wide range of the region R. In the embodiment 2-2, an asymmetrical property of the shape of the magnetic flux density Br distribution of the regulating pole N2 was improved. Specifically, in the embodiment 2-2, the ratio of the difference between the point A and the point B2 of the regulating pole N2 to the angle difference between the point A and the point B1 of the regulating pole N2 is about 1:4. That is, $4 \geq X/Y > 1$ is satisfied. As a result, the position of Bθ=0 in the embodiment 2-2 is substantially the same position as the downstream end 52*b* of the regulating blade 52, so that the deposited toner collection efficiency was improved more than in the comparison example and the embodiment 2-1.

Incidentally, a desirable position of the angle of B=0 of the regulating pole N2 and the material of the regulating blade 52 are similar to those in the first embodiment. Further, in this embodiment, the above-described constitution of the arrangement and the magnetic flux density distribution of the regulating blade 52 is also applicable to the constitution with no vibration generating means.

Third Embodiment

A third embodiment will be described using part (a) of FIG. 9 to FIG. 10 while making reference to FIGS. 3 and 4. In this embodiment, magnetic flux density distribution of the regulating pole N2 is made different from the first embodiment. Other constitutions and actions are similar to those in the first embodiment, and therefore, the similar constitutions are omitted from description and illustration or briefly described by adding the same reference numerals or symbols, and in the following, a difference from the first embodiment will be principally described.

Also, in the case of this embodiment, the position where the magnetic flux density Bθ of the regulating pole N2 in the tangential direction at the surface of the supplying roller 51 becomes 0 is positioned on a side downstream of an upstream end of the regulating blade 52 with respect to the normal rotational direction of the supplying roller 51 which is the rotational direction of the supplying roller 51 during the image formation. Further, preferably, the position where the magnetic flux density Bθ of the regulating pole N2 in the tangential direction at the surface of the supplying roller 51 becomes 0 is positioned on a side downstream of a downstream end of the regulating blade 52 with respect to the normal rotational direction.

On the other hand, in this embodiment, different from the first embodiment, in the case where a position where the magnetic flux density Br of the regulating blade pole N2 in the normal direction at the surface of the supplying roller 51 becomes maximum is a first position (point A), a position on a side downstream of the first position and where the magnetic flux density Br Bθ of the regulating pole N2 in the tangential direction at the surface of the supplying roller 51 becomes 0 is a fourth position (point D), an angle difference between the first position and the fourth position with respect to the normal rotational direction is Z, and an angle difference between the first position and the upstream end 52*a* of the regulating blade 52 with respect to the normal rotational direction is Ga, Z≥Ga is satisfied. Further, preferably, in the case where an angle difference between the first position and the downstream end 52*b* of the regulating blade 52 with respect to the normal rotational direction is Gb, Z≥Gb is satisfied.

As described above, in the embodiment 1-2, compared with the comparison example, the position of the magnetic flux density Bθ=0 of the regulating pole N2 was set at a position on a side downstream of the downstream end 52*b* of the regulating blade 52 with respect to the normal rotational direction of the supplying roller 51. According to a study by the present inventor, in the case where the position of the magnetic flux density Bθ=0 of the regulating pole N2 is in a position downstream of the regulating blade 52, a fluidized layer (bed) of the developer at the periphery of the chain position is narrow. That is, a change in shearing surface by a fluctuation in position of the pole due to a part tolerance or a mounting tolerance of the regulating pole N2 is small, so that a change in layer thickness to the fluctuation in position of the pole is small. On the other hand, when the position of the magnetic flux density Br of the magnetic pole N2 is upstream of the regulating blade 52, a change in layer thickness to a fluctuation in gap between the supplying roller 51 and the regulating blade 52 is large.

In an embodiment 3, a constitution in which the change in layer thickness to the fluctuation in gap between the supplying roller 51 and the regulating blade 52 is substantially the same as the layer thickness change in the comparison example while improving the deposited toner collection efficiency.

Part (a) of FIG. 9 is a graph schematically showing a distribution of the magnetic flux density Br of the magnet roller 51*a* on the supplying roller 51 in each of the embodiment 1-2 and the embodiment 3, and part (b) of FIG. 9 is a graph schematically showing a distribution of the magnetic flux density Bθ of the magnet roller 51*a* on the supplying roller 51 in each of the embodiment 1-2 and the embodiment 3.

Further, in parts (a) and (b) of FIG. 9, similarly as in parts (a) and (b) of FIG. 6, a positional relationship between the upstream end 52*a* and the downstream end 52*b* of the free end of the regulating blade 52 on opposite sides with respect to the rotational direction of the supplying roller 51, a bonding portion 53*e* between the toner receiving surface 53*c* and the toner dropping surface 53*d*, and the magnetic flux density Bθ, and the developer feeding direction (rotational direction of the supplying roller 51 (normal rotational direction), arrow direction) were also shown. In the embodiment 3, a difference from the embodiment 1-2 is that the shape of the magnetic flux density Br of the regulating pole N2 is made asymmetrical, so that the position of Bθ=0 is positioned downstream of the upstream end 52*a* of the regulating blade 52 with respect to the normal rotational direction of the supplying roller 51 while the magnitude and the position of the maximum value of the magnetic flux density Br are made the same as those in the comparison example. By this, the deposited toner collection efficiency was improved more than the comparison example.

Here, the asymmetrical shape of the magnetic flux density Br of the graph pole N2 in the embodiment 3 will be described using FIG. 10. FIG. 10 is an enlarged view of the magnetic flux density Br at the periphery of the regulating pole N2 in embodiment 3 shown in parts (a) and (b) of FIG. 9. The point A is the position where the magnitude of the magnetic flux density Br becomes maximum. The point D is the position (point) where the magnetic flux density Bθ becomes 0. Y represents the angle difference between the point A and the point D.

Specifically, in the embodiment 3, the angle difference (Z) between the point A and the point D of the regulating pole N2 is about 10°. Incidentally, the angle difference (Z) between the point A and the point D of the regulating pole N2 in the comparison example is about 2°.

In the case of the comparison example, when the angle difference Ga between the point A and the upstream end 52*a* of the regulating blade 52 is Ga, Ga is 5°, so that the position of the magnetic flux density Bθ=0 is upstream of the upstream end 52*a* of the regulating blade 52.

In the case of the embodiment 3, the position of the point A is the same as the position of the point A in the comparison example, and therefore, Ga is 5°. On the other hand, the angle difference (Z) between the positions of the point A and the point D is 10°. That is, Z≥Ga holds. For this reason, the position (point D) of the magnetic flux density Bθ=0 is positioned downstream of the upstream end 52*a* of the regulating blade 52.

As a result, compared with the comparison example, in the embodiment 3, a constitution in which the change in layer thickness to the fluctuation in gap between the supplying roller 51 and the regulating blade 52 is substantially the same as the layer thickness change in the comparison example while improving the deposited toner collection efficiency is employed.

Accordingly, it is preferable that the angle difference (Z) between the positions of the points A and D is larger than at least the angle difference (Ga) between the point A and the upstream end 52*a* of the regulating blade 52. Further, preferably, the angle difference (Z) between the positions of the points A and D is larger than the angle difference (Gb) between the point A and the downstream end 52*b* of the regulating blade 52. That is, Z≥Gb may preferably be satisfied.

According to the constitution of the embodiment 3, the deposited toner collection efficiency can be improved while suppressing the change in layer thickness to the fluctuation in gap between the supplying roller 51 and the regulating blade 52. Incidentally, a desirable position of the angle of B=0 of the regulating pole N2 and the material of the regulating blade 52 are similar to those in the first embodiment. Further, in this embodiment, the above-described constitution of the arrangement and the magnetic flux density distribution of the regulating blade 52 is also applicable to the constitution with no vibration generating means.

Other Embodiments

In the above-described embodiments, the case where the present invention is applied to the developing device for use in the image forming apparatus of the tandem type was described. However, the present invention is also applicable to the developing device for use in the image forming apparatus of another type. Further, the image forming apparatus is not limited to the image forming apparatus for a full-color image, but may also be an image forming apparatus for a monochromatic image or an image forming apparatus for a mono-color (single color) image. Or, the image forming apparatus can be carried out in various uses, such as printers, various printing machines, copying machines, facsimile machines and multi-function machines by adding necessary devices, equipment and casing structures or the like.

Further, also as regards the structure of the developing device, as described above, the structure is not limited to a structure in which the developing chamber and the stirring chamber are disposed in the horizontal direction, but may also be a structure in which the developing chamber and the stirring chamber are disposed in a direction inclined with respect to the horizontal direction. In summary, a constitution in which the developing chamber as the first chamber and the stirring chamber as the second chamber are disposed adjacent to each other so as to partially overlap with each other as viewed in the horizontal direction may only be employed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2022-011048 filed on Jan. 27, 2022, which is hereby incorporated by reference herein in its entirety.

What is claimed is:

1. A developing device comprising:

a developing container configured to accommodate a developer containing toner and a carrier;

a developing roller configured to carry and convey the toner to a developing position where an electrostatic latent image formed on an image bearing member is developed with the toner;

a supplying roller provided opposed to the developing roller and configured to supply only the toner to the developing roller while carrying and conveying the developer supplied from the developing container, the supplying roller being rotated during image formation in a rotational direction opposite to a rotational direction of the developing roller in a position where the supplying roller and the developing roller oppose each other;

a first magnet provided non-rotationally and fixedly inside the developing roller and including a first magnetic pole;

a second magnet provided non-rotationally and fixedly inside the supplying roller and including:

a second magnetic pole which is provided opposed to the first magnetic pole in a position where the supplying roller opposes the developing roller and which is different in polarity from the first magnetic pole, and a third magnetic pole which is provided on a side upstream of the second magnetic pole with respect to the rotational direction of the supplying roller during the image formation, and a regulating member provided opposed to the third magnetic pole and configured to regulate an amount of the developer carried on the supplying roller, wherein during non-image formation, an operation in a mode in which the supplying roller is rotated in a direction opposite to the rotational direction of the supplying roller during the image formation is executable, and wherein with respect to the rotational direction of the supplying roller during the image formation, a position where a magnet flux density of the third magnetic pole in a tangential direction to an outer peripheral surface of the supplying roller is zero is positioned downstream of an upstream end of the regulating member and upstream of the second magnetic pole.

2. A developing device according to claim 1, wherein with respect to the rotational direction of the supplying roller during the image formation, the position where a magnet flux density of the third magnetic pole in a tangential direction to an outer peripheral surface of the supplying roller is zero is positioned downstream of a downstream end of the regulating member and upstream of the second magnetic pole.

3. A developing device according to claim 1, wherein in a case that:

a position where a magnetic flux density of the third magnetic pole in a normal direction to an outer peripheral surface of the supplying roller is maximum is a first position, with respect to the rotational direction of the supplying roller during the image formation, a position which is on a side upstream of the first position and downstream of the second magnetic pole and at which a magnetic flux density in the normal direction to the outer peripheral surface of the supplying roller becomes zero is a second position, with respect to the rotational direction of the supplying roller during the image formation, a position which is on a side downstream of the first position and upstream of the second magnetic pole and at which a magnetic flux density in the normal direction to the outer peripheral surface of the supplying roller becomes zero is a third position, with respect to the rotational direction of the supplying roller during the image formation, an angle between the first position and the second position is X, and with respect to the rotational direction of the supplying roller during the image formation, an angle between the first position and the third position is Y, the following relationship is satisfied:

$$2 \geq X/Y > 1.$$

4. A developing device according to claim 1, wherein in a case that:

a position where a magnetic flux density of the third magnetic pole in a normal direction to an outer peripheral surface of the supplying roller is maximum a first position, with respect to the rotational direction of the supplying roller during the image formation, a position which is on a side upstream of the first position and downstream of the second magnetic pole and at which a magnetic flux density in the normal direction to the outer peripheral surface of the supplying roller becomes zero is a second position, with respect to the rotational direction of the supplying roller during the image formation, a position which is on a side downstream of the first position and upstream of the second magnetic pole and at which a magnetic flux density in the normal direction to the outer peripheral surface of the supplying roller becomes zero is a third position, with respect to the rotational direction of the supplying roller during the image formation, an angle between the first position and the second position is X, and with respect to the rotational direction of the supplying roller during the image formation, an angle between the first position and the third position is Y, the following relationship is satisfied:

$$4 \geq X/Y > 1.$$

5. A developing device according to claim 1, wherein in a case that:

a position where a magnetic flux density of the third magnetic pole in a normal direction to an outer peripheral surface of the supplying roller is maximum is a first position, with respect to the rotational direction of the supplying roller during the image formation, a position which is on a side downstream of the first position and upstream of the second magnetic pole and at which the magnetic flux density of the third magnetic pole in the tangential direction to the outer peripheral surface of the supplying roller becomes zero is a second position, with respect to the rotational direction of the supplying roller during the image formation, an angle between the first position and the second position is Z, and with respect to the rotational direction of the supplying roller during the image formation, an angle between the first position and the upstream end of the regulating member is Ga, the following relationship is satisfied:

$$Z \geq Ga.$$

6. A developing device according to claim 1, wherein in a case that:

a position where a magnetic flux density of the third magnetic pole in a normal direction to an outer peripheral surface of the supplying roller is maximum is a first position, with respect to the rotational direction of the supplying roller during the image formation, a position which is on a side downstream of the first position and upstream of the second magnetic pole and at which the magnetic flux density of the third magnetic pole in the tangential direction to the outer peripheral surface of the supplying roller becomes zero is a second position, with respect to the rotational direction of the supplying roller during the image formation, an angle between the first position and the second position is Z, and with respect to the rotational direction of the supplying roller during the image formation, an angle between the first position and a downstream end of the regulating member is Gb, the following relationship is satisfied:

$$Z \geq Gb.$$

7. A developing device according to claim 1, further comprising:

a toner receiving member provided below the developing roller and configured to receive the toner dropping from the developing roller; and vibrating means configured to vibrate the toner receiving member, wherein in the operation in the mode, in a state in which the toner receiving member is vibrated by the vibrating means during the non-image formation, the supplying roller is capable of being rotated in the direction opposite to the rotational direction of the supplying roller during the image formation.

* * * * *